US010216143B2

(12) United States Patent
Kawaguchi et al.

(10) Patent No.: US 10,216,143 B2
(45) Date of Patent: Feb. 26, 2019

(54) IMAGE FORMING APPARATUS HAVING A LUBRICANT AND DEVELOPER OF OPPOSITE POLARITY

(71) Applicant: CANON KABUSHIKI KAISHA, Tokyo (JP)

(72) Inventors: Yuji Kawaguchi, Tokyo (JP); Satoru Motohashi, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/842,060

(22) Filed: Dec. 14, 2017

(65) Prior Publication Data

US 2018/0107147 A1 Apr. 19, 2018

Related U.S. Application Data

(62) Division of application No. 14/683,494, filed on Apr. 10, 2015, now Pat. No. 9,874,848.

(30) Foreign Application Priority Data

Apr. 17, 2014 (JP) ..... 2014-085460

(51) Int. Cl.
*G03G 21/18* (2006.01)
*G03G 15/08* (2006.01)
(Continued)

(52) U.S. Cl.
CPC ..... *G03G 21/1828* (2013.01); *G03G 15/0806* (2013.01); *G03G 21/0094* (2013.01); *G03G 21/181* (2013.01); *G03G 21/1661* (2013.01)

(58) Field of Classification Search
CPC ..... G03G 21/0094; G03G 21/1661; G03G 21/181; G03G 21/1828
See application file for complete search history.

(56) References Cited

U.S. PATENT DOCUMENTS 5,697,028 A 12/1997 Kobayashi et al.
7,398,040 B2 7/2008 Yoshida
(Continued)

FOREIGN PATENT DOCUMENTS

JP 08-211728 A 8/1996
JP H08-211768 A 8/1996
(Continued)

OTHER PUBLICATIONS

European Search Report dated Aug. 27, 2015, in related European Patent Application No. 15163801.2.
(Continued)

*Primary Examiner* — David M. Gray
*Assistant Examiner* — Laura Roth
(74) *Attorney, Agent, or Firm* — Venable LLP

(57) ABSTRACT

An image forming apparatus includes a cartridge having an image bearing member and a developer bearing member that bears a developer, and a detection unit configured to detect if the cartridge is new. A lubricant of a polarity opposite to a polarity of the developer is coated on the developer bearing member, and if the cartridge is detected to be new, prior to start of an image forming operation, a discharging operation of discharging the lubricant from a surface of the developer bearing member onto the image bearing member is performed. When a predetermined time elapses from a start of the discharging operation and before an end of the discharging operation, a potential difference between a surface potential of the image bearing member and a surface potential of the developer bearing member is set smaller than when the discharging operation is started.

9 Claims, 23 Drawing Sheets

(51) Int. Cl.
*G03G 21/00* (2006.01)
*G03G 21/16* (2006.01)

(56) References Cited

U.S. PATENT DOCUMENTS

| | | | |
|---|---|---|---|
| 2005/0048269 | A1 | 3/2005 | Shimamura et al. |
| 2006/0078356 | A1 | 4/2006 | Inami et al. |
| 2011/0150512 | A1 | 6/2011 | Tamagaki |
| 2011/0268463 | A1 | 11/2011 | Kimura et al. |
| 2015/0063834 | A1 | 3/2015 | Kobayashi et al. |

FOREIGN PATENT DOCUMENTS

| | | | | | |
|---|---|---|---|---|---|
| JP | 08-227212 | A | | 9/1996 | |
| JP | 08227212 | A | * | 9/1996 | ..... G03G 15/0808 |
| JP | 2002-328569 | A | | 11/2002 | |
| JP | 3397510 | B2 | | 4/2003 | |
| JP | 2008-216944 | A | | 9/2008 | |
| JP | 4261941 | B2 | | 5/2009 | |
| JP | 2011-007831 | A | | 1/2011 | |
| JP | 4928023 | B2 | | 5/2012 | |

OTHER PUBLICATIONS

Chinese Office Action dated Dec. 3, 2018, in corresponding Chinese Patent Application No. 201510182431.9 (with English translation).

* cited by examiner t=t0 t=t1 t=t2 t=t3 t=t4 t=t5

IMAGE FORMING APPARATUS HAVING A LUBRICANT AND DEVELOPER OF OPPOSITE POLARITY

This application is a divisional of application Ser. No. 14/683,494, filed Apr. 10, 2015

BACKGROUND OF THE INVENTION

Field of the Invention

The present invention relates to an image forming apparatus.

Description of the Related Art

Many conventional image forming apparatuses such as copiers and printers use an electrostatic recording system, an electrophotographic system, or the like. Image forming apparatuses such as copiers and printers which are based on the electrophotographic system or the electrostatic recording system use a developing assembly using developer (hereinafter also referred to as toner). The developing assembly is provided with a developing chamber and a toner container in which toner is contained.

The developing chamber is provided with a developing roller (developer bearing member), and a toner feeding member that applies toner to a surface of the developing roller. The developing chamber is also provided with a toner regulating member that levels the toner coated by a toner feeding member on the surface of the developing roller into a more even thin layer. The thin layer of toner resulting from the leveling by the toner regulating member is conveyed out from the developing assembly in conjunction with rotation of the developing roller. The thin layer of toner attaches to an electrostatic latent image on a rotative photosensitive drum (image bearing member) disposed opposite an exposed portion of the developing roller, to visualize the electrostatic latent image. Thus, a toner image is formed on the photosensitive drum.

Before the developing assembly starts to be used, that is, when the developing assembly is new, the toner remains contained in the toner container. The toner is fed from the inside of the toner container into the developing chamber for the first time when the developing assembly starts to foe used. Thus, before the developing assembly starts to be used, the developing roller is in direct contact with the toner regulating member and the toner feeding member with no toner present between the developing roller and the toner regulating member and toner feeding member. Consequently, torque may be increased in a driving system for the developing assembly, Thus, in Patent publication no. 3397510, the toner feeding member has a cell on the uppermost surface and has powder (toner or the like) with a particular charging capability at least on a front surface of the toner feeding member. This prevents the driving system for the developing assembly from being broken as a result of an increase in the driving torque on the developing assembly. Similarly, a technique is known in which a lubricant is coated on the developing roller to prevent the driving system for the developing assembly from being broken (Patent publication No. 4928023).

In a new developing assembly, the toner in the toner container is provided with no charge. Thus, even when the toner is provided with charge at a contact region between the toner regulating member and the developing roller, the toner has difficulty immediately reaching an appropriate toner charge level. Consequently, sufficient developing performance may fail to be achieved, and density may be low or characters may be thin. Accordingly, in Patent, publication No. 4261941, the polarity of the lubricant coated on the developing roller is set opposite to the polarity of the toner to inhibit a decrease in density and in the thickness of characters at the stage where the developing assembly starts to be used.

SUMMARY OF THE INVENTION

However, in Patent publication No. 4261941, when the lubricant is coated on the developing roller (developer bearing member) and held instead of being discharged, the toner and the lubricant may be mixed together to cause formation of streaks or the like, affecting images.

With the foregoing problem in view, it is an object of the present invention to maintain image quality in the configuration in which the lubricant is coated on the development bearing member.

To accomplish the object, the image forming apparatus according to the present invention comprising detachably a cartridge including an image bearing member and a developer bearing member that bears developer, wherein a lubricant of a polarity opposite to a polarity of the developer is coated on the developer bearing member, and if the cartridge is new, a discharging operation of discharging the lubricant from a surface of the developer bearing member onto the image bearing member is performed.

The present invention allows images quality to be maintained in the configuration in which the lubricant is coated on the development bearing member.

Further features of the present invention will become apparent from the following description of exemplary embodiments with reference to the attached drawings.

DESCRIPTION OF THE EMBODIMENTS

Embodiments of the present invention will be described using examples with reference to the drawings. Dimensions, materials and shapes of the components and relative configurations thereof according to the embodiments should be appropriately changed in accordance with the configuration and various conditions of the apparatus to which the invention is applied. In other words, the following embodiments are not intended to limit the scope of the present invention.

Present Embodiment

<Image Forming Apparatus>

Figure 1:
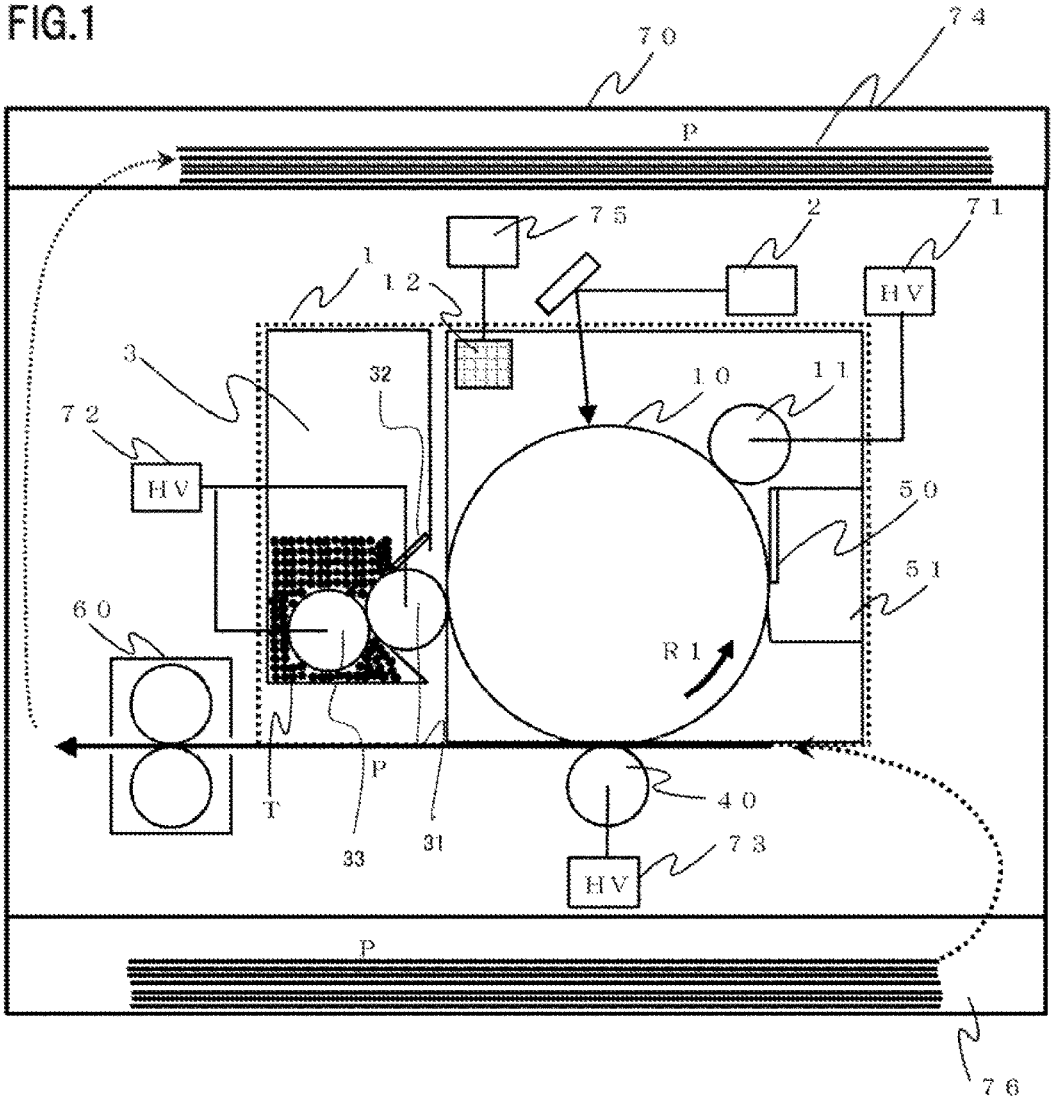
FIG. 1 is a schematic cross-sectional view depicting a configuration of an image forming apparatus according to Embodiments 1 to 3 and 5.

With reference to FIG. 1, a configuration of an image forming apparatus such as a copier or a printer according to the present embodiment will be described. FIG. 1 is a schematic cross-sectional view depicting a configuration of the image forming apparatus according to the present embodiment. The image forming apparatus according to the present embodiment includes a process cartridge 1 removably installed in an apparatus main body 70.

First, to evenly charge a surface of a photosensitive drum 10 serving as an image bearing member, a predetermined DC voltage is applied to a charging roller 11 serving as a charging unit, using a high-voltage power supply 71 provided in the apparatus main body 70. At this time, a voltage of about −1,000 V is applied to the photosensitive drum 10 using the charging roller 11. Subsequently, to form an electrostatic latent image on the surface of the photosensitive drum 10, the photosensitive drum 10 is irradiated by an exposure apparatus 2 with laser light resulting from modulation of image information transmitted by an information processing device (not depicted in the drawings). LED light may also be radiated to the photosensitive drum 10 by the exposure apparatus 2. For the potential of the surface of the photosensitive drum 10 according to the present embodiment, a dark-area potential Vd is −450 V, and a light-area potential Vl is −150 V.

Then, to make the electrostatic latent image a visible image, a predetermined DC voltage is applied to a developing assembly 3 using a high-voltage power supply 72 provided in the apparatus main body 70, to develop on the photosensitive drum 10 nonmagnetic one-component developer T with negative charging performance (hereinafter referred to as toner) contained in the developing assembly 3. Thus, a toner image is formed on the surface of the photosensitive drum 10 as a developer image. At this time, a developing bias Vdc of about −400 V is applied to a developing roller 31. Such potential setting prevents the toner with the negative polarity from attaching to an unexposed portion at the dark-area potential Vd, while allowing the toner to attach to an exposed portion at the light-area potential Vl.

Then, to allow the toner image on the surface of the photosensitive drum 10 to be transferred to a recording material P, the recording material P is conveyed from a cassette 76 in synchronization with formation of the toner image. Then, a predetermined voltage is applied by a high-voltage power supply 73 to a transfer roller 40 that, is a transfer unit, to transfer the toner image on the surface of the photosensitive drum 10 to the recording material P. At this time, most of the toner image is transferred to the recording material P, but part of the toner image fails to be transferred to the recording material P and remains on the photosensitive drum 10. The toner image transferred to the recording material P is fixed thereto as a permanent image by being heated and pressured by a fixing device 60 serving as a fixing unit. The recording material P is then accumulated on a sheet discharging tray 74 outside the apparatus main body 70.

Furthermore, waste toner having failed to be transferred to the recording material P and remaining on the photosensitive drum 10 is scraped off by a cleaning blade 50 which is in contact with the photosensitive drum 10 and which serves as a cleaning member. The waste toner is accumulated in a cleaning container 51. Thus, the surface of the photosensitive drum 10 is refreshed. Subsequently, a similar process is repeated to continue image formation.

<Developing Assembly>

Figure 2:
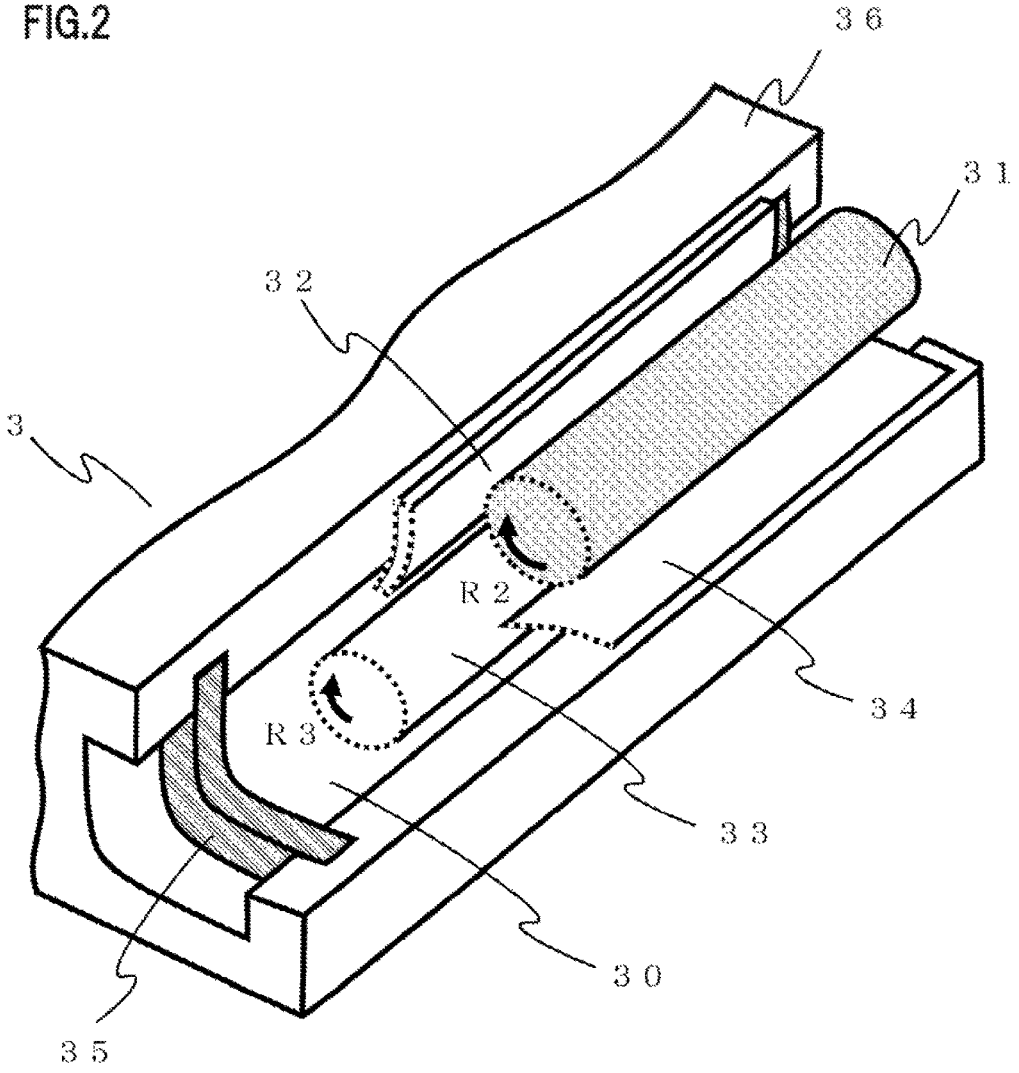
FIG. 2 is a schematic perspective view depicting a configuration of a developing assembly according to Embodiments 1 to 4.

Now, a general configuration of the developing assembly according to the present embodiment will be described with reference to FIG. 2. FIG. 2 is a schematic perspective view depicting a configuration of the developing assembly according to the present embodiment. In FIG. 2, some members positioned on a front side are depicted in a partially cutaway view in order to illustrate the disposition of the members.

The developing assembly 3 has the developing roller 31 serving as the developer bearing member, a developing blade 32 serving as a regulating member, and a toner feeding roller 33 serving as a feeding member that feeds toner to the developing roller 31. The developing assembly 3 further has a blowout preventing sheet 34 and a developing end seal 35 serving as toner leakage preventing members. These members are provided in a frame 36.

Toner contained in the frame 36 (not depicted in the drawings) is fed to the developing roller 31 via the frame 36 and a developing opening 30 defined by the blowout preventing sheet 34 and the developing end seal 35. The developing roller 31 is an elastic roller and is rotatable in the direction of arrow R2. The developing blade 32 is formed of a SOS plate and contacts the developing roller 31 to regulate the amount of toner on the developing roller 31 (developer bearing member) to a substantially constant value. The toner feeding roller 33 is a rotatable roller member formed of a foaming member that can contain toner. The toner feeding roller 33 rotates in the direction of arrow R3 in contact with the developing roller 31, to feed toner T to the developing roller 31. The blowout preventing sheet 34 is a flexible sheet member and closely contacts the developing roller 31 and the developing end seal 35 to prevent the toner from leaking through the frame 36. The developing end seal 35 is an elastic member having fine nap implanted on a surface thereof that contacts the developing roller 31. The developing end seal 35 closely contacts the developing roller 31, the developing blade 32, the blowout preventing sheet 34, and the frame 36 to prevent the toner from leaking through an end of the frame 36.

<Process Cartridge>

Figure 3:
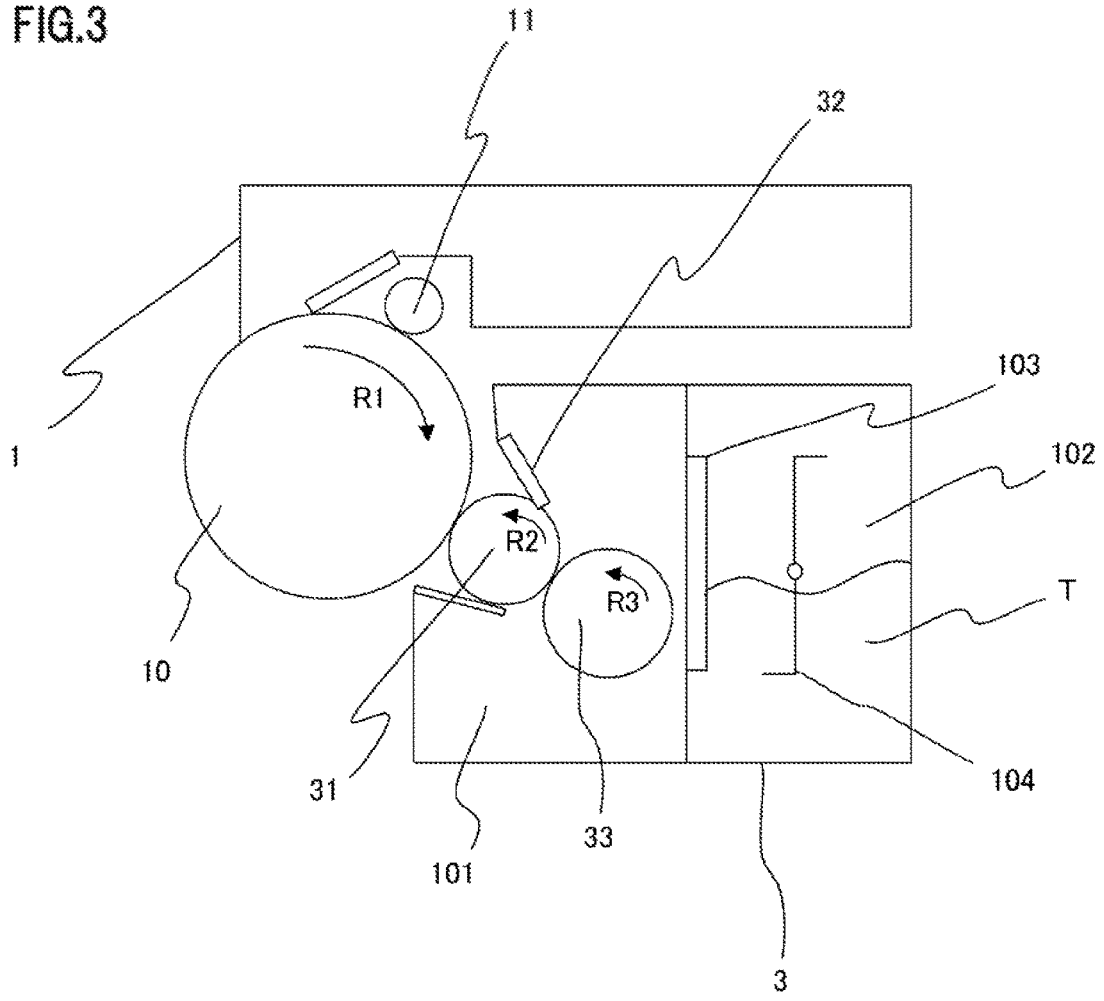
FIG. 3 is a schematic cross-sectional view depicting a configuration of a process cartridge according to Embodiments 1 to 3 and 5.

Moreover, a configuration of the process cartridge 1 according to the present embodiment and a further detailed configuration of the developing assembly 3 will be described with reference to FIG. 3. FIG. 3 is a schematic cross-sectional view depicting the configuration of the process cartridge according to the present embodiment. As depicted in FIG. 3, the process cartridge 1 includes the photosensitive drum 10, the charging roller 11, and the developing assembly 3.

The developing assembly 3 includes a developing chamber 101 with an opening in a portion thereof opposite to the photosensitive drum 10, and a toner container 102 disposed behind and in communication with the developing chamber 101 and serving as a developer container in which the toner T is contained. The opening through which the developing chamber 101 and the toner container 102 are in communication with each other is closed by a seal member 103 so as to prevent the toner T in the toner container 102 from flowing into the developing chamber 101. The seal member 103 is removed from the opening when the developing assembly 3 starts to be used. The seal member 103 allows the toner T to be contained in the toner container 102 before the developing assembly 3 starts to be used, to prevent the toner from flowing into the developing chamber 101.

The seal member 103 may be configured such that a user peels off the seal member 103 to expose the opening before use or such that the seal member 103 is automatically peeled off at a timing when the apparatus is driven after power-on. In Embodiment 1 described below, the user peels off the seal member 103. In Embodiment 2 described below, the seal member 103 is automatically peeled off by a removal unit 15. The seal member 103 prevents the toner T from inadvertently flowing out from the developing assembly 3 as a result of vibration during, for example, transportation of the developing assembly 3, thus staining the user, the developing assembly 3, the apparatus main body 70, and the like with the toner.

Furthermore, the developing chamber 101 is provided with the developing roller 31 so that the developing roller 31 is partly exposed from the developing chamber 101 and is rotatable. The developing roller 31 lies opposite the photosensitive drum 10 so as to press and contact the photosensitive drum 10 at a predetermined penetration level. Moreover, the developing chamber 101 houses the toner feeding roller 33 allowing the toner conveyed from the toner container 102 by a conveying member 104 to be fed to the developing roller 31.

At the time of a developing operation, the seal member 103 is removed from the developing assembly 3 to form the toner container 102 and the developing chamber 101 into one space, enabling the toner T in the toner container 102 to be fed to the developing chamber 101 for the first time. The conveying member 104 conveys the toner T beyond a partitioning wall toward the toner feeding roller 33. The toner T is coated on the developing roller 31 by the toner feeding roller 33. The toner T borne on the developing roller 31 is regulated to a predetermined layer thickness by a toner regulating member 32 and then fed to a developing zone opposite to the photosensitive drum 10.

In the developing assembly 3 unused, the toner T is contained in the toner container 102 using the seal member 103 so as not to fly as a result of external vibration or impact. In other words, in the unused, state, no toner is present on the developing roller 31, and thus, a very high torque is needed to drive the developing roller 31. In this state, forcible driving may cause the toner feeding roller 33 to be broken due to friction between the developing roller 31 and the toner feeding roller 33 or cause the developing blade 32 to be curled back in a rotating direction of the developing roller 31 due to friction between the developing roller 31 and the developing blade 32.

To solve these problems, a powdery lubricant is precoated on any of the developing roller 31, the developing blade 32, and the toner feeding roller 33 according to the present embodiment. An excessively small amount of lubricant coated on the developing roller 31 hinders the torque reduction effect from being exerted. An excessively large amount of lubricant coated on the developing roller 31 cause the lubricant to fly as a result of vibration or impact.

<Description of the Lubricant>

Now, details of the lubricant used in the present embodiment will be described. In the present embodiment, as the lubricant, powder is selected which is used to control flowability and environmental stability. Examples of the powder with these characteristics include, for example, resin powder, that is, fine vinylidene fluoride and fine polytetrafluoroethylene powder. Other examples of such powder include fatty acid metal salts, that is, zinc stearate, calcium stearate, and lead stearate. Other examples of such powder include metal oxides, that is, zinc oxide powder, silica, alumina, titanium oxide, and tin oxide. Other examples of such powder include the above-described silica the surface of which is treated with a silane coupling agent, titanium coupling agent, silicon oil, or the line.

Figure 4:
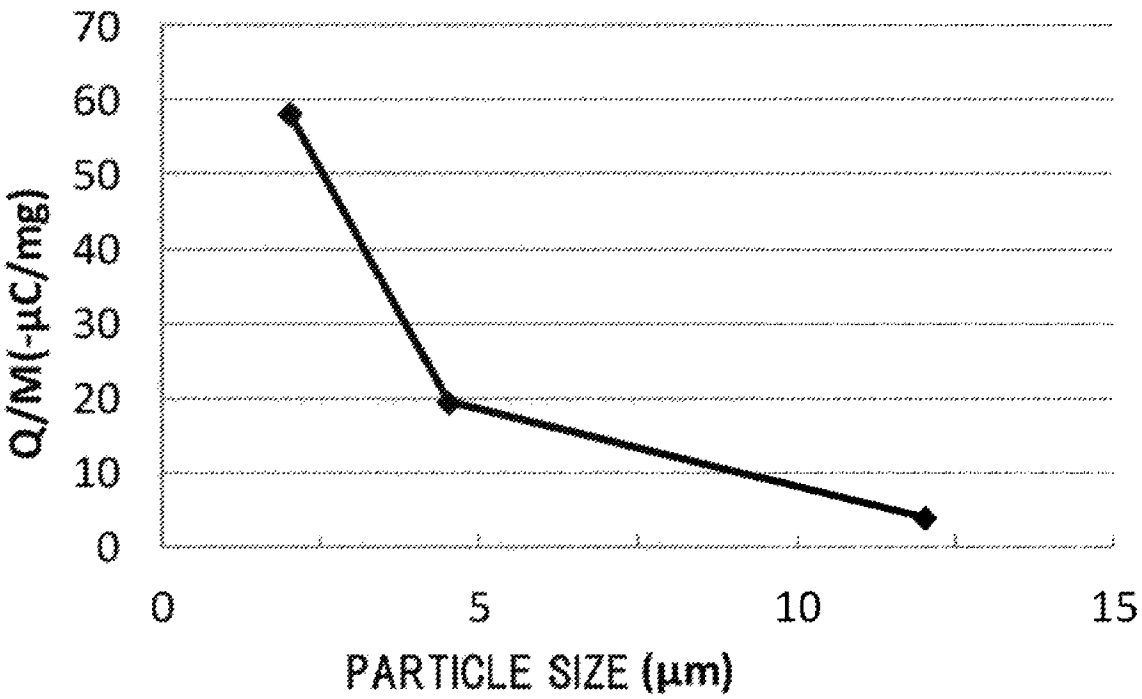
FIG. 4 is a graph depicting the relation between weight average particle size and charge.

However, not all of the above-described types of powder may be used as the lubricant. To allow the lubricant to be coated on the developing roller 31, the amount of charge in the lubricant needs to be controlled. A parameter used to control the amount of charge is particle size. FIG. 4 depicts the relation between weight average particle size and charge amount observed when TOSPEARL (manufactured by Momentive Performance Materials Inc.) was used as the lubricant. The weight average particle size was measured using a particle size measuring apparatus Multisizer III (trade name; manufactured by BECKMAN COULTER). As an electrolyte, an approximately 1% water solution of sodium chloride adjusted using primary sodium chloride was used. Approximately 0.5 ml alkyl benzene sulfonate was added to approximately 100 ml electrolyte as a dispersing agent. The total of 5 mg of measurement specimens was further added to the solution and suspended. A dispersion treatment was executed on the electrolyte with the specimens suspended therein for one minute, using an ultrasonic disperser. The volume and number of the measurement specimens were measured using the above-described measurement apparatus and a 100-μm aperture. A volume distribution and a number-of-specimens distribution were then calculated. Based on these results, the weight average particle size was calculated, and for three samples with different weight average particle sizes, the charge amount was measured using an electrometer (manufactured by TFF Corporation Keithley Instruments). The results are depicted in FIG. 4.

The above-described results indicate that, with a reduced weight average particle size, the charge amount of the particles and thus the force of attachment to the developing roller 31 increase to allow the effects of the lubricant to be exerted. However, the lubricant itself fails to be discharged from the surface of the developing roller 31, affecting images. On the other hand, with an increased weight average particle size, the charge amount of the particles and thus the electrostatic attachment force decrease, precluding application to the developing roller 31.

In view of this, the present embodiment used, as the lubricant, Dynamic Beads UCN-5060D Clear (manufactured by Dainichiseika Color & Chemicals Mfg. Co., Ltd.) that are perfect spherical cross-linked particulates of polyurethane resin with the charge amount adjusted to an appropriate value. As the particle size, a weight average particle size of 7.2 μm was used, and the charge amount was adjusted to +20 to 50 μC/mg. The amount of lubricant applied is suitably set to $0.1\times10^{-2}$ to $4.4\times10^{-2}$ (kg/m$^2$).

Three typical methods described below are available for coating the lubricant on the contact region between the developing roller 31 and the toner regulating member 32. However, the method is not particularly limited as long as the method allows even application. A first method involves pre-coating the lubricant on the entire developing roller 31 and installing the developing roller 31 in the developing assembly 3 with the toner regulating member 32 attached thereto. In second method involves pre-coating the lubricant on the contact region between the toner regulating member 32 and the developing roller 31 and installing the toner regulating member 32 in the developing assembly 3. A third method involves coating the lubricant all over the toner feeding roller 33, installing the toner feeding roller 33 in the developing assembly 3, then incorporating the developing roller 31 and the toner regulating member 32 into the developing assembly 3, driving and rotating the developing assembly 3, and coating the lubricant on the contact region between the developing roller 31 and the toner regulating member 32. In the second and third methods, the lubricant pre-coated on the toner regulating member 32 and the toner feeding roller 33 is fed to the developing roller 31 before an operation of discharging the lubricant is performed. The lubricant is thus coated on the developing roller 31.

Figure 5:
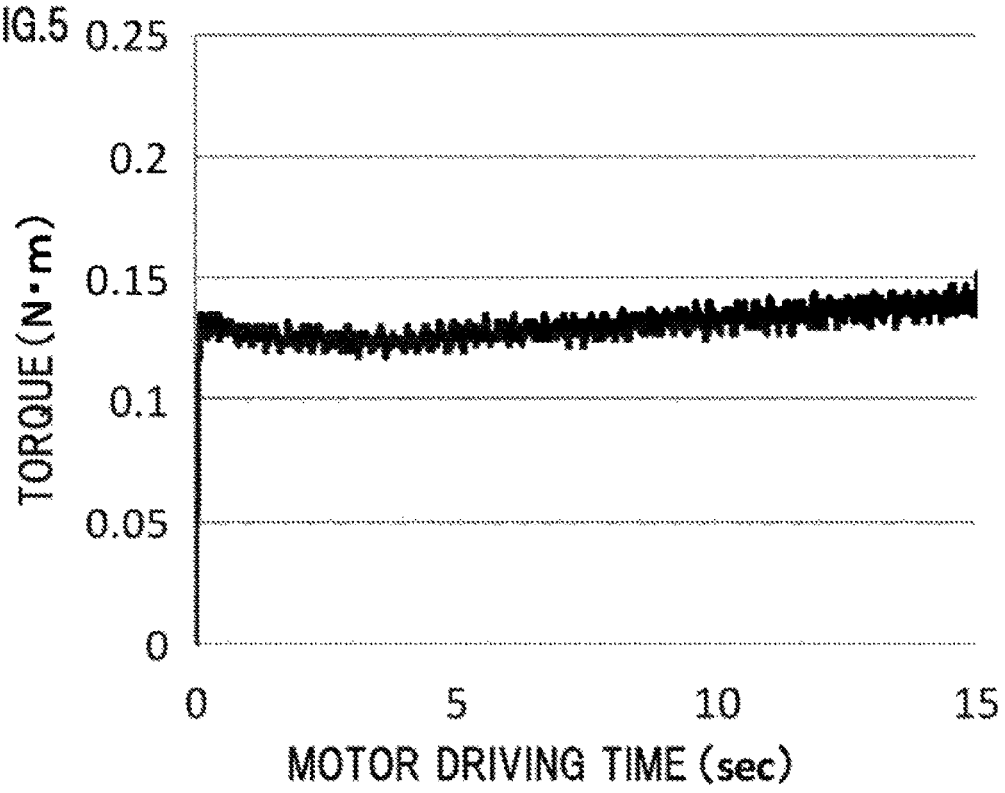
FIG. 5 is a graph depicting a variation in driving torque.

Subsequently, the driving torque was measured which was obtained when polyurethane particles were used as the lubricant, FIG. 5 is a graph depicting a variation in the driving torque on the process cartridge 1 obtained when a driving start time is set to 0s. The results indicate that, at the time of rotation, no toner is fed, but no variation in torque is observed, with the torque remaining stable. Thus, the polyurethane particles function as a lubricant to reduce the torque. In the present embodiment, the amount of lubricant coated was $1.0\times10^{-2}$ (kg/m$^2$).

<Operation for Detecting a New Process Cartridge>

Now, a method for detecting the usage history of the process cartridge 1 will be described with reference to FIG. 1. The apparatus main body 70 in the present embodiment has communication unit 75 as a detection unit for detecting a new process cartridge 1. The process cartridge 1 in the present embodiment includes, as a unit for detecting replacement of the process cartridge 1 with a new one, the life of the toner or the photosensitive drum 10, or the like, a storage element 12 serving as a storage unit.

The storage element 12 can store identification information on the process cartridge 1, life information, image process information, and the like to allow the latest state of the process cartridge 1 to be constantly determined, enabling the optimum image formation. The storage element 12 can communicate with the communication unit 75 serving as a detection unit in the apparatus main body 70. The usage history of, for example, the total number of sheets printed using the process cartridge 1 can be written to the process cartridge 1.

Furthermore, the storage element 12 and the communication unit 75 can communicate sequentially with each other, and thus, the communication unit 75 can load data from the storage element 12 to change the operation of the apparatus main body 70 or update the data in the storage element 12. In the present embodiment, when the process cartridge 1 is inserted into the apparatus main body 70, the communication unit 75 loads the data from the storage element 12, and when no usage history (the history of operation of the process cartridge 1) is present, detects (determines) that the process cartridge 1 is new.

<Sequence of Operations for a New Process Cartridge>

When the communication unit 75 serving as a detection unit determines that the process cartridge 1 is new, no toner is coated on the developing roller 31. Thus, the toner feeding roller 33 is to be impregnated with the toner to allow the toner to be steadily fed onto the developing roller 31. Thus, a sequence for a new process cartridge is executed as a step prior to a printing operation (image formation operation) is started.

Figure 6:
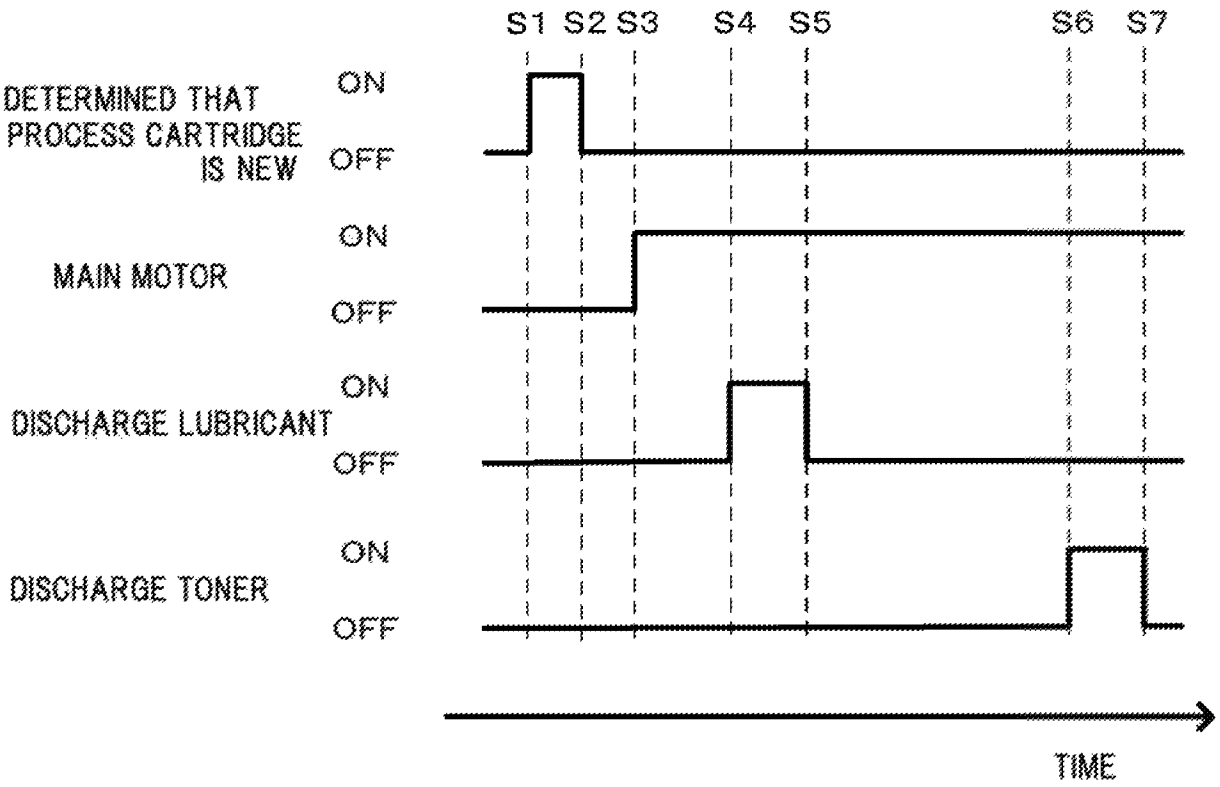
FIG. 6 is a timing chart for sequence operations for a new process cartridge.

Now, with reference to FIG. 6, operations during the sequence for a new process cartridge will be described in detail. FIG. 6 is a diagram depicting a timing chart of sequence operations for a new process cartridge according to the present embodiment. First, the main body power supply is turned on, and a new process cartridge 1 is inserted. Then, the communication unit 75 determines that the process cartridge 1 is new (S1). When the communication unit 75 completes detecting that the process cartridge 1 is new (S2), driving of the main motor is turned on (S3) to start operating rotating members in the apparatus main body 70 such as the photosensitive drum 10 and the developing roller 31 and operating various high-voltage power supplies. Then, when the main motor is driven, the process cartridge 1 performs an operation of discharging the lubricant (S4). When the lubricant is discharged (S5), the toner T is coated on the developing roller 31. When the feeding of the toner from the toner feeding roller 33 is stabilized, an operation of discharging the toner (developer discharging operation) is subsequently performed (S6). When the discharge of the toner is complete (S7), the sequence operations for a new process cartridge 1 are ended. In this regard, the operation of discharging the toner refers to an operation of feeding the toner T, serving as the lubricant, from the developing assembly 3 to the cleaning blade 50 via the photosensitive drum 10.

The cleaning blade 50 provided in the process cartridge 1 is formed of polyurethane rubber that is a type of thermoplastic elastomer in view of chemical resistance, wear resistance, moldability, mechanical strength, and the like. In particular, when the process cartridge 1 is new and the user starts to use the process cartridge 1 or when a cartridge is replaced, only a small amount of substance such as residual toner is present which functions as a lubricant, causing a high fractional force to be exerted between an edge of the cleaning blade 50 and the photosensitive drum 10. Thus, problems are likely to occur such as curl-up or vibration of the cleaning blade 50. Thus, when a new process cartridge 1 has been found to be installed based on the storage element 12, the apparatus main body 70 in the present embodiment discharges the toner T during the sequence operations for a new process cartridge performed immediately after the installation. The toner T is fed via the photosensitive drum 10 to the cleaning blade 50 all over the longitudinal region thereof to reduce the friction between the photosensitive drum 10 and the cleaning blade 50. This prevents problems such as curl-up and vibration of the cleaning blade 50.

Embodiment 1

<Features of Embodiment 1>

Now, features of Embodiment 1 will be described. In Embodiment 1, at lubricant of a polarity opposite to the polarity of the toner is used. An image forming apparatus according to Embodiment 1 is characterized in that, during the sequence for a new process cartridge, the lubricant coated on the developing roller 31 and having a polarity opposite to the polarity of the toner is discharged onto the photosensitive drum 10 (image bearing member) without posing any problem. In this regard, the charging performance with the opposite polarity means that the toner and the lubricant have different electric polarities such as different charging characteristics, that is, positive charge and negative charge. The charging performance with the same polarity means that the toner and the lubricant have the same electric polarity such as the same charging characteristic, that is, positive charge or negative charge. In Embodiment 1, since the toner and the lubricant are in the relation of the opposite polarities, toner particles function in a manner electrically opposite to the manner in which lubricant particles function.

Figure 7A:
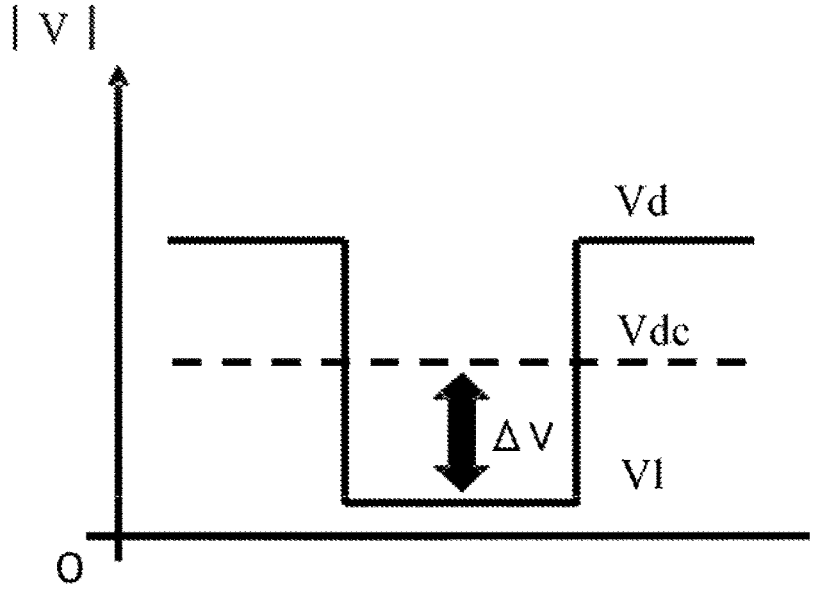
FIG. 7A and FIG. 7B are diagrams depicting development contract.
Figure 7B:
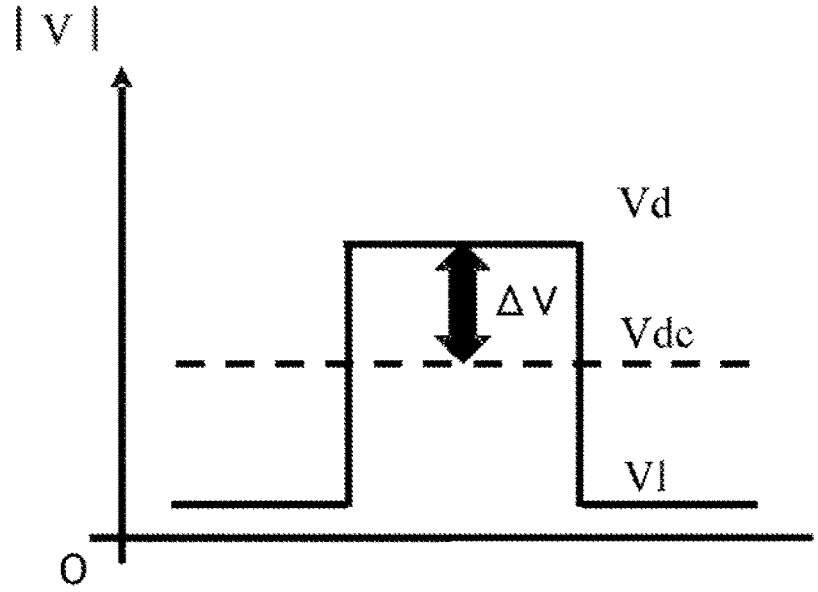

FIG. 7A and FIG. 7B are diagrams depicting a developing contrast ΔV and illustrating the relation between the surface potential of the photosensitive drum 10 and the developing bias during printing of a solid black image and during printing of a solid white image according to Embodiment 1. FIG. 7A depicts a potential relation in which, during printing of a solid black image, particles with the negative polarity, that is, the toner, flies from the developing roller 31 onto the photosensitive drum 10. FIG. 7B depicts a potential relation in which, during printing of a solid white image, the lubricant of a positive polarity flies from the developing roller 31 onto the photosensitive drum 10. The toner, charged to the negative polarity, is developed at the light-area potential Vl, which corresponds to a positive side with respect to the developing bias. The lubricant, charged to the positive polarity, is developed at the dark-area potential Vd, which corresponds to a negative side with respect to the developing bias. In this regard, the development means a process in which the toner or the lubricant flies from the developing roller 31 onto the photosensitive drum 10. Furthermore, as depicted in FIG. 7A and FIG. 7B, the potential difference between the surface potential of the photosensitive drum 10 and the developing bias applied to the developing roller 31 is denoted by ΔV (hereinafter referred to as the developing contrast).

Figure 8:
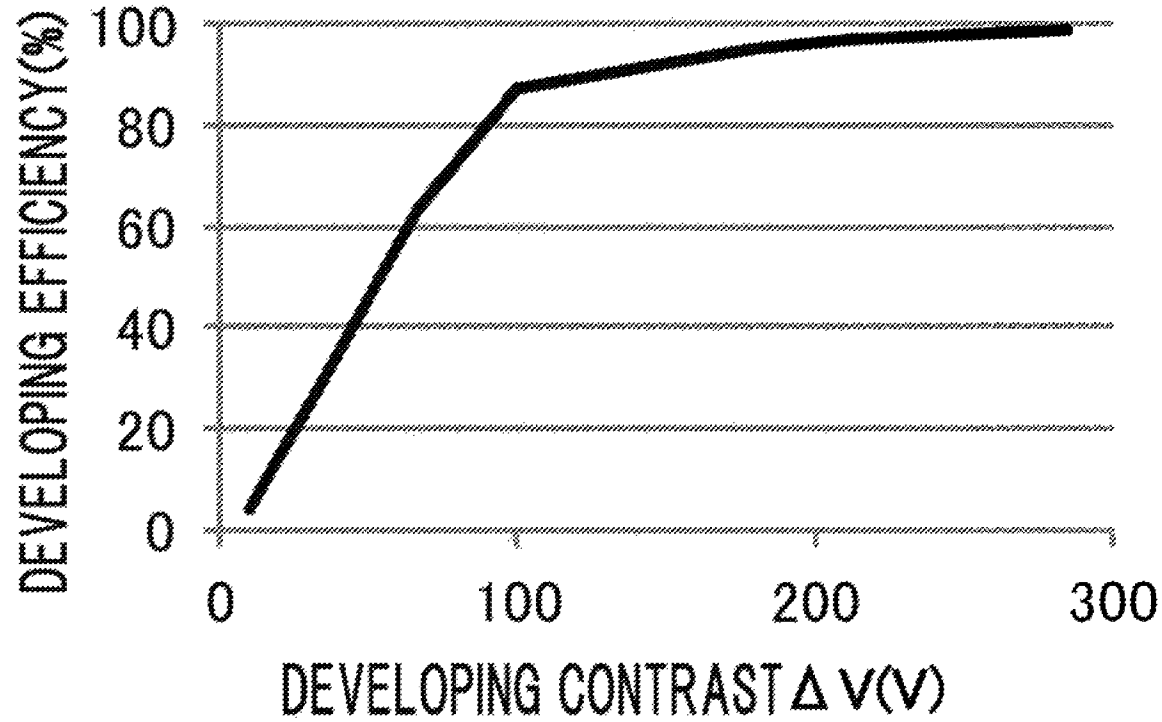
FIG. 8 is a graph depicting the relation between developing contrast and development efficiency.
Figure 9:
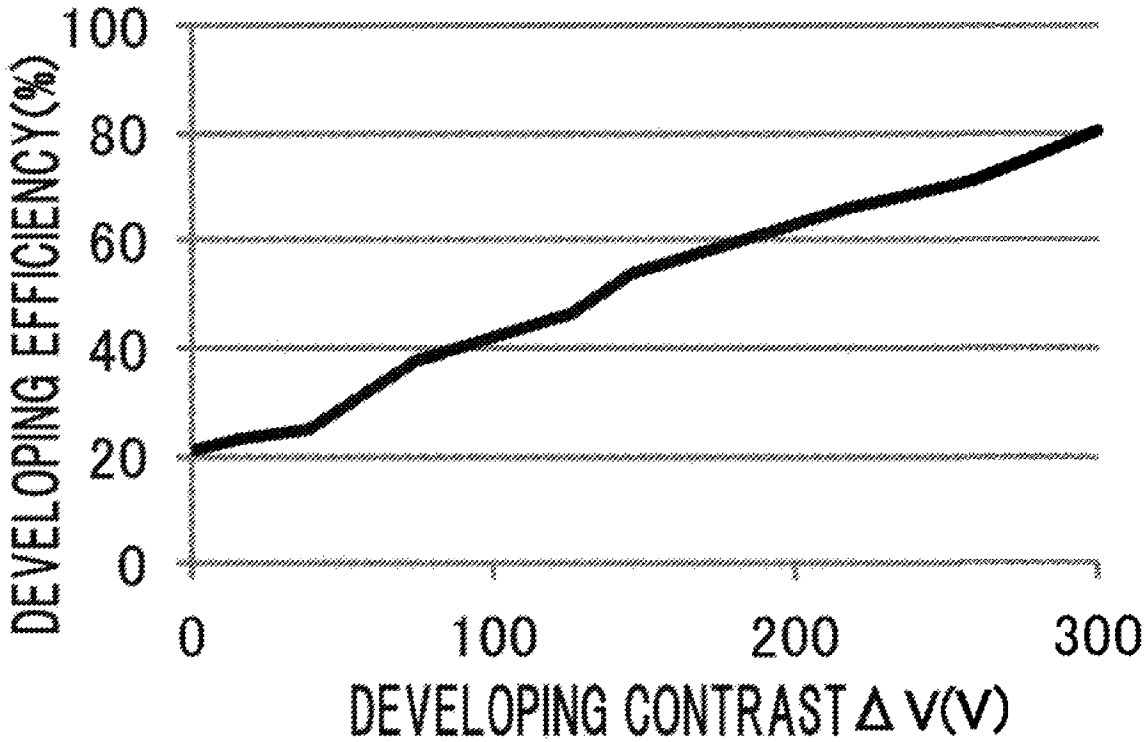
FIG. 9 is a graph depicting the relation between developing contrast and development efficiency.

Now, the behavior of blowing out the toner and the lubricant is illustrated with reference to FIG. 8 and FIG. 9. FIG. 8 depicts a variation in the rate at which the toner is transferred, during development, from the developing roller to the photosensitive drum when Vl and Vd are varied to vary the developing contrast ΔV after the toner is borne on the developing roller. On the other hand, FIG. 9 depicts a variation in the rate at which the toner is transferred, during development, from the developing roller to the photosensitive drum when Vl and Vd are varied to vary the developing contrast ΔV after the lubricant is borne on the developing roller. Specifically, in FIG. 8, the amount of toner is estimated which is developed on the photosensitive drum 10 at the time of each potential relation when the toner amount measured when all of the toner on the developing roller 31 is developed on the photosensitive drum 10 is set to be 100%. This also applies to the lubricant in FIG. 9.

As depicted in FIG. 8, as the Vl is increased with respect to the developing bias Vdc to enhance the developing contrast ΔV, the rate of the toner developed on the photosensitive drum 10 increases. On the other hand, for the lubricant of the positive polarity, as the Vd is increased with respect to the developing bias Vdc to enhance the developing contrast ΔV, the rate of the lubricant developed on the photosensitive drum 10 increases as depicted in FIG. 9. To wrap up, it is apparent that enhancement of the developing contrast ΔV with respect to the developing bias Vdc increases the amount of toner transferred from the developing roller 31 to the photosensitive drum 10 during development. This suggests that, regardless of the polarity to which the particles are charged, the amount of particles discharged from the developing roller 31 and the polarity can be adjusted by controlling the surface potential on the photosensitive drum 10 and the developing bias Vdc.

Figure 10:
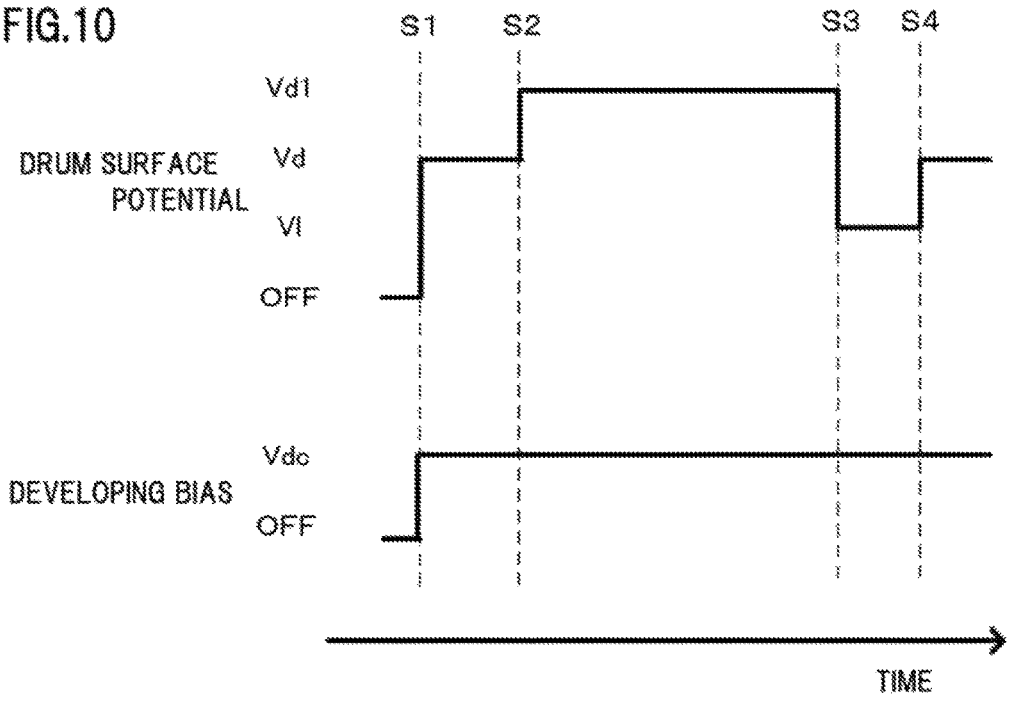
FIG. 10 is a graph, depicting the transition of the potentials of a photosensitive drum and a developing roller during the sequence for a new process cartridge.

Now, the operation of Embodiment 1 will be described with reference to FIG. 10. The operations of the sequence for a new process cartridge before discharge of the lubricant and coating of the toner will be described in accordance with the transition of the potential. An initial operation is as depicted in FIG. 6. First, the process cartridge 1 is inserted into the apparatus main body 70, and before the use of the process cartridge 1 is started, the user pulls the seal member 103 (see FIG. 3) to feed the toner T into the developing chamber 101.

As depicted in FIG. 6 described above, when the main body power supply is turned on and a new process cartridge 1 is inserted, the above-described detection of the new process cartridge 1 is performed (S1). When the detection is complete (S2), the driving of the main motor is turned on (S3) to start operating rotating members such as the developing roller 31 and the photosensitive drum 10 in the apparatus main body 70 and operating the various high-voltage power supplies. Subsequently, a procedure for discharging the lubricant is executed (S4). FIG. 10 depicts the transition, in a procedure described below, of the potentials of the photosensitive drum 10 and the developing roller 31 during the sequence for a new process cartridge according to Embodiment 1. The timing corresponding to 34 in FIG. 6 is S1 in FIG. 10.

The lubricant is discharged from the developing roller 31, on which the lubricant has been pre-coated, onto the photosensitive drum 10 (S1). Then, the main motor drives and rotates the toner feeding roller 33. A predetermined time after the start of the discharging operation, when a sufficient amount of the toner state is contained in the toner feeding roller 33 so that the developing roller 31 can be coated with the toner, the absolute value of the surface potential of the photosensitive drum 10 is increased to allow the photosensitive drum 10 to discharge the lubricant. That is, the difference in surface potential between the photosensitive drum 10 and the developing roller 31 is increased above the potential difference obtained at the start of the discharging operation. This increases a charging bias applied to the charging roller 11 further toward negative values (up to Vd1) than Vd (S2).

Finally, when the discharge of the lubricant is complete, the surface of the photosensitive drum 10 is subjected to exposure by the exposure apparatus 2 to reduce the absolute value of the surface potential of the photosensitive drum 10 with respect to the developing bias, down to Vl, in order to feed the toner onto the cleaning blade 50 (S3). When the discharge of the toner is complete, the surface potential of the photosensitive drum 10 is changed back to Vd (S4) to end the sequence for a new process cartridge. The above-described series of operations is performed to allow the lubricant of the opposite polarity to be discharged from the developing roller 31 while the sequence for a new process cartridge is in execution.

The other embodiments described below will be described based on the potential relation in FIG. 10. The potentials Vd and Vl may be changed as needed depending on the toner fed from the toner feeding roller 33. For example, the absolute value of Vd may be increased in order to energetically discharge the lubricant and reduced in order to suppress the discharge. For the toner, similar operations may be performed on Vl.

<Effects of Embodiment 1>

The effects of Embodiment 1 will be described compared to the effects of Comparative Embodiments 1 to 5. Table 1 depicts the evaluation of the torque obtained when the potential in S2 and S3 in FIG. 10 (Vd1) was changed and the evaluation of the adverse effects of the torque on a printed image such as possible streaks on the image. In this regard, the developing bias is denoted by Vdc, and the developing contrast (Vd1−Vdc) is denoted by ΔV. Examinations were made with the developing bias Vdc maintained constant such that a change in Vd1 simultaneously changed the developing contrast ΔV.

TABLE 1

| | Vd1 (−V) | Vdc (−V) | ΔV (V) | Torque | Streaks on image |
|---|---|---|---|---|---|
| Embodiment 1 | 500 | 350 | 150 | ○ | ○ |
| Comparative Embodiment 1 | 600 | 350 | 250 | Δ | ○ |
| Comparative Embodiment 2 | 350 | 350 | 0 | ○ | Δ |

Torque o: The initial torque was maintained
Torque Δ: The torque increased slightly from initial value
Streaks on image o: The image suffered no adverse effect
Streaks on image Δ: A few streaks were formed In Comparative Embodiment 1, the developing contrast ΔV was set higher than in Embodiment 1. Thus, the lubricant on the developing roller 31 is discharged onto the photosensitive drum 10 in a short time. As a result, the coat layer on the developing roller 31 was lost, causing a rapid increase in torque between the developing roller 31 and the toner regulating member 32. This leads to the need to change the driving force exerted to drive the developing roller 31.

In Comparative Embodiment 2, the developing contrast ΔV was set lower than in Embodiment 1. Thus, the discharge was suppressed to allow the initial torque to be maintained. However, the lubricant remained on the developing roller 31 to vary the density of the toner in the longitudinal direction of the developing roller 31, disadvantageously resulting in streaks on the image.

As is apparent from the above-described results, providing the appropriate developing contrast ΔV enables both suppression of an increase in torque and reduction of the adverse effect on image quality.

Table 2 depicts a comparison of evaluations of toner consumption, torque, and image defects observed when the potential in 32 and S3, Vd1, was changed, in Embodiment 1 where a lubricant of a polarity opposite to the polarity of the toner was used and in Comparative Embodiments 3 to 5 where a lubricant of the same polarity as that of the toner was used. In this case, the developing bias Vdc is constant at −350 V. In the present examinations, the polarity of the lubricant is inverted. Thus, in the configuration in Embodiment 1, |Vd1|>|Vdc| is needed in order to allow the particles with the positive polarity to fly onto the photosensitive drum 10, whereas |Vd1|<|Vdc| is needed in order to allow the particles with the negative polarity to fly onto the photosensitive drum 10. Accordingly, the value of the developing contrast ΔV is represented as an absolute value in Table 2. An increased absolute value facilitates flying of the lubricant onto the photosensitive drum 10.

TABLE 2

| | Polarity of lubricant | Vd1 (−V) | \|ΔV\| (V) | Toner consumption | Torque | Streaks on image |
|---|---|---|---|---|---|---|
| Embodiment 1 | + | 500 | 150 | ○ | ○ | ○ |
| Comparative Embodiment 3 | − | 350 | 0 | ○ | ○ | X |
| Comparative Embodiment 4 | − | 250 | 100 | X | ○ | Δ |
| Comparative Embodiment 5 | − | 50 | 300 | XX | ○ | ○ |

Toner consumption o: Appropriate
Toner consumption x: High
Toner consumption xx: Considerably high
Torque o: The initial torque was maintained
Streaks on image o: No streak was formed
Streaks on image Δ: A few streaks were formed
Streaks on image x: Many streaks were formed In Comparative Embodiment 3, the developing contrast is set such that the lubricant remains on the developing roller 31. Thus, the initial torque can be held, but the lubricant remains on the developing roller 31, leading to adverse effects on the image such as streaks on the image. In Comparative Embodiment 4, the potentials are in relationship allowing the lubricant to be discharged, and thus, the lubricant is discharged from the surface of the developing roller 31. Therefore, the image is not significantly affected and the torque can be ensured. However, since the lubricant and the toner are of the same polarity, when the lubricant is discharged, the toner coated on the developing roller 31 is simultaneously developed. Consequently, the toner consumption is higher than in Embodiment 1. Furthermore, in Comparative Embodiment 5, the potentials are in relationship allowing the lubricant to be completely removed from the developing roller 31, leading to no adverse effect on the image. However, more toner is discharged than in Comparative Embodiment 4, resulting in a high toner consumption.

As is apparent from the above-described results, when the toner and the lubricant are of the same polarity as seen in Comparative Embodiments 3 to 5, the discharge is only possible in such a manner that the toner and the lubricant are discharged together when mixed together. In contrast, when the toner and the lubricant are of the opposite polarities as in Embodiment 1, either the toner or the lubricant, for example, the lubricant can exclusively be discharged by controlling the potentials. This enables the torque to be adjusted, improving image quality.

As described above, in Embodiment 1, an increase in torque and the adverse effect on image quality can be reduced by pre-coating the developing roller 31 with the lubricant of the polarity opposite to the polarity of the toner and executing the sequence for a new process cartridge using the appropriate developing contrast.

Embodiment 2

<Features of Embodiment 2>

Features of Embodiment 2 will be described with reference to FIG. 11 and FIG. 12. In a configuration of an image forming apparatus according to Embodiment 2, the same components as those of Embodiment 1 are denoted by the same reference numerals and will not described below. In Embodiment 1, the user pulls out the toner seal member 103. However, Embodiment 2 adopts an automatic pulling configuration in which the toner seal member 103 is automatically removed using a driving force input to the process cartridge 1. In Embodiment 2, the operation of discharging the lubricant is performed based on a time from the start of the operation of removing the toner seal member 103 until the removing operation is completed. Embodiment 2 is characterized in that, for a case where a time difference occurs between the start of execution of the sequence for a new process cartridge and the timing when the toner is coated on the developing roller 31, the lubricant coated on the developing roller 31 and exhibiting charging performance with the polarity opposite to the polarity of the toner is discharged onto the photosensitive drum 10 without any problem. Given a time lag before the toner is coated on the developing roller 31, in the configuration as seen in Embodiment 1, the lubricant is discharged earlier than the toner, possibly increasing the torque.

Figure 11:
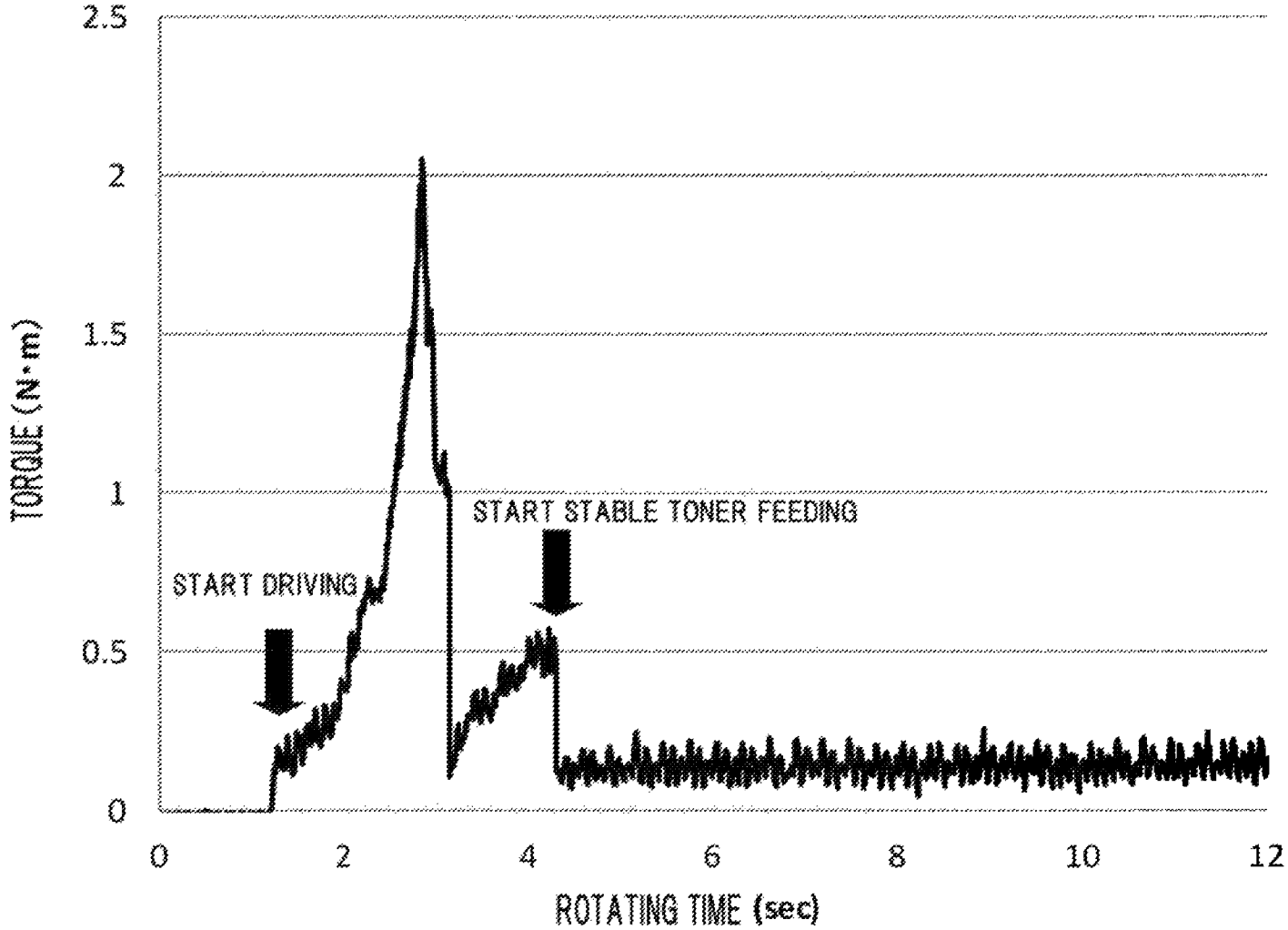
FIG. 11 is a graph depicting the transition of torque at the time when no lubricant is present on the developing roller.
Figure 12:
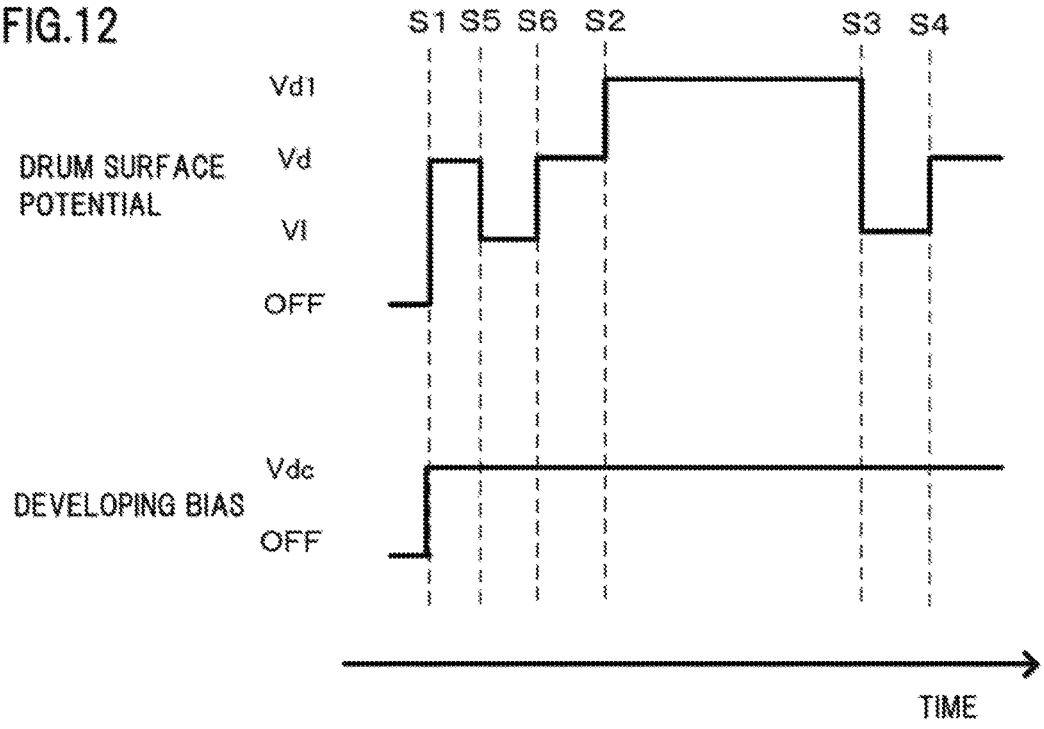
FIG. 12 is a graph depicting the transition of the potentials of the photosensitive drum and the developing roller during the sequence for a new process cartridge.

For confirmation of an increase in torque as a result of the absence of a lubricant from the developing roller 31, FIG. 11 depicts the transition of the torque obtained after the toner seal member 103 is automatically pulled away using the removal unit 15 when the developing roller 31 is coated with no lubricant. Immediately after the toner seal member 103 is automatically pulled away, the toner falls freely and moves gradually toward the peripheries of the toner feeding roller 33 and the developing roller 31. In view of this, examinations were conducted under the most severe conditions where the present operation is hindered. The transition depicted in FIG. 11 is the results of examinations conducted under the most severe conditions where, at low temperature and low humidity, the process cartridge 1 was placed such that the longitudinal direction of the process cartridge 1 was perpendicular to the ground, tapping was performed for one hour using a vibration apparatus, and then the seal member was removed at high temperature and high humidity. It is expected that, after the tests are conducted on the process cartridge 1, the toner T in the toner container 102 is collected on one side and hindered from falling.

The results in FIG. 11 indicate that the torque remains unstable and has a large absolute value after driving is started and before the toner starts to fall. Subsequently, as depicted in FIG. 11, the torque is stabilized approximately three seconds after the start of removal of the seal member. This means that, at this time, the toner is being stably fed to the developing roller 31. Thus, when all of the lubricant is discharged within at least three seconds after the start of driving of the main motor, destruction of an apparatus such as breakage of a driving gear may result from an increased torque. Hence, in Embodiment 2, the lubricant needs to remain on the developing roller 31 at least three seconds after the start of driving.

On the other hand, FIG. 9, described above in Embodiment 1, indicates that a lubricant of polyurethane particles flies at a certain rate with respect to Vd, and thus, not all of the lubricant flies even when the lubricant is not continuously exposed for three seconds. Thus, the torque can be stably maintained by adjusting the potentials. Furthermore, the amount of time until the feeding is stabilized since when the toner starts to fall is three seconds as indicated in the results for the most sever conditions where vertical tapping was performed. Consequently, under normal conditions, the toner is expected to start to foe fed at a timing earlier than three seconds after the start of driving.

Based on the above description, in Embodiment 2, the surface of the photosensitive drum 10 is subjected to exposure and set to the potential Vl as a step prior to the discharge of the lubricant, thus establishing a potential relationship in which the lubricant is prevented from flying to the photosensitive drum 10.

The transition of the potentials of the photosensitive drum 10 and the developing roller 31 during the sequence for a new process cartridge according to Embodiment 2 will be described below with reference to FIG. 12. First, the user turns on the main body power supply and inserts a new process cartridge 1 into the apparatus main body 70. Then, the communication unit 75 determines whether or not the process cartridge 1 is new based on the data stored in the storage element 12. Subsequently, the charging high voltage and the developing high voltage are turned on. Then, the developing roller 31, the photosensitive drum 10, and the toner feeding roller 33 are driven, and the developing bias is adjusted to Vdc, while the charging bias is adjusted to Vd (S1). When charging of the photosensitive drum 10 is complete for an entire circumference thereof (when the photosensitive drum 10 is charged along a circumferential direction thereof), exposure is started (S5). That is, before a predetermined time elapses from the start of the discharging operation, the surface potential of the photosensitive drum 10 is changed such that the potential difference between the surface of the photosensitive drum 10 and the surface of the developing roller 31 is smaller than when the discharging operation is started. During the exposure, the toner is gradually moved from the toner container 102 to the developing chamber 101 by the conveying member 104, and fed to the toner feeding roller 33. When preparations are made to allow the developing roller 31 to be coated with the toner, the exposure is stopped to change the surface potential of the photosensitive drum 10 back to Vd such that the lubricant is discharged onto the photosensitive drum 10 from the developing roller 31 coated with the lubricant (S6).

Then, driving of the main motor rotates the toner feeding roller 33. When a sufficient amount of the toner T in the process cartridge 1 is contained in the toner feeding roller 33 so that the developing roller 31 can be coated with the toner (when the predetermined time elapses), the surface potential of the photosensitive drum 10 is increased to allow the photosensitive drum 10 to discharge the lubricant. The charging bias applied to the charging roller 11 at this time is set to Vd1 (S2). Finally, when the discharge of the lubricant is complete, the surface of the photosensitive drum 10 is subjected to exposure by the exposure apparatus 2 to reduce the surface potential of the photosensitive drum 10 with respect to the developing bias, down to Vl, in order to feed the toner T onto the cleaning blade 50 (S3). When the discharge of the toner is complete, the surface potential of the photosensitive drum 10 is changed back to Vd (S4) to end the sequence for a new process cartridge.

The potential relation according to the present embodiment is similar to the potential relation in Embodiment 1. The time and potentials in S5 and S6 in FIG. 12 may be changed as needed depending on the falling state of the toner and the lubricant. The above-described operations allow the lubricant of the polarity opposite to the polarity of the toner coated on the developing roller 31 to be discharged onto the photosensitive drum 10 without any adverse effect, for the case where a time difference occurs between the start of execution of the sequence for a new process cartridge and the timing when the toner is coated on the developing roller 31.

<Effects of Embodiment 2>

The effects of Embodiment 2 will be described. Comparative Examples 6 and 7 will be used to describe the effects of formation of the potential Vl for allowing effective discharge of the lubricant of the opposite polarity coated on the developing roller 31, for the case where a time difference occurs between the start of execution of the sequence for a new process cartridge and the timing when the toner is coated on the developing roller 31. Table 3 depicts the evaluation of the torque and the evaluation of the toner consumption and a drum memory observed when the exposure time that is the time between S5 and S6 in FIG. 12 is changed.

TABLE 3

| | Exposure time (sec) | Torque | Toner consumption/ memory |
|---|---|---|---|
| Embodiment 2 | 0.3 | ○ | ○ |
| Comparative Embodiment 6 | 0 | Δ | ○ |
| Comparative Embodiment 7 | 3 | ○ | Δ |

Torque o: The initial torque was maintained

Torque Δ: The torque increased slightly from the initial value

Toner consumption/memory o: Appropriate

Toner: consumption/memory Δ: Slightly high toner consumption

In Comparative Example 6, no exposure is performed (the exposure time is 0 seconds). Thus, the lubricant on the developing roller 31 is discharged onto the photosensitive drum 10 before the toner is fed to the developing roller 31. Thus, the coat layer on the developing roller 31 is lost, causing a rapid increase in torque between the developing roller 31 and the toner regulating member 32. In Comparative Example 7, exposure is performed for a time equal to the time needed for the toner to fall down (the exposure time is three seconds). Thus, the lubricant is prevented from being blown away, and the torque remains stable. However, the long exposure time facilitates toner consumption and is also disadvantageous in terms of the drum memory. On the other hand, in Embodiment 2, the exposure time is set to the appropriate value, allowing achievement of both the effect of the lubricant for torque stabilization and the effect of the extended exposure time for inhibition of adverse effects.

As described above, in Embodiment 2, the lubricant of the opposite polarity coated on the developing roller 31 can be effectively discharged, for the case where a time difference occurs between the start of execution of the sequence for a new process cartridge and the timing when the toner is coated on the developing roller 31.

Embodiment 3

<Features of Embodiment 3>

How, features of Embodiment 3 will be described. Embodiment 3 is characterized in that a lubricant coated on the developing roller 31 and exhibiting charging performance with a polarity opposite to the polarity of the toner is discharged onto the photosensitive drum 10, for the case where a time difference occurs between the start of execution of the sequence for a new process cartridge and the timing when the toner is coated on the developing roller 31. Embodiment 2 discloses that, when a time lag occurs in the feeding of the toner, the potential Vl can be effectively formed by means of exposure. However, the exposure may produce an adverse effect as described above. Thus, Embodiment 3 is characterized in that the exposure time is shortened and in that an area is provided from which the lubricant is difficult to discharge even after the exposure.

Figure 13:
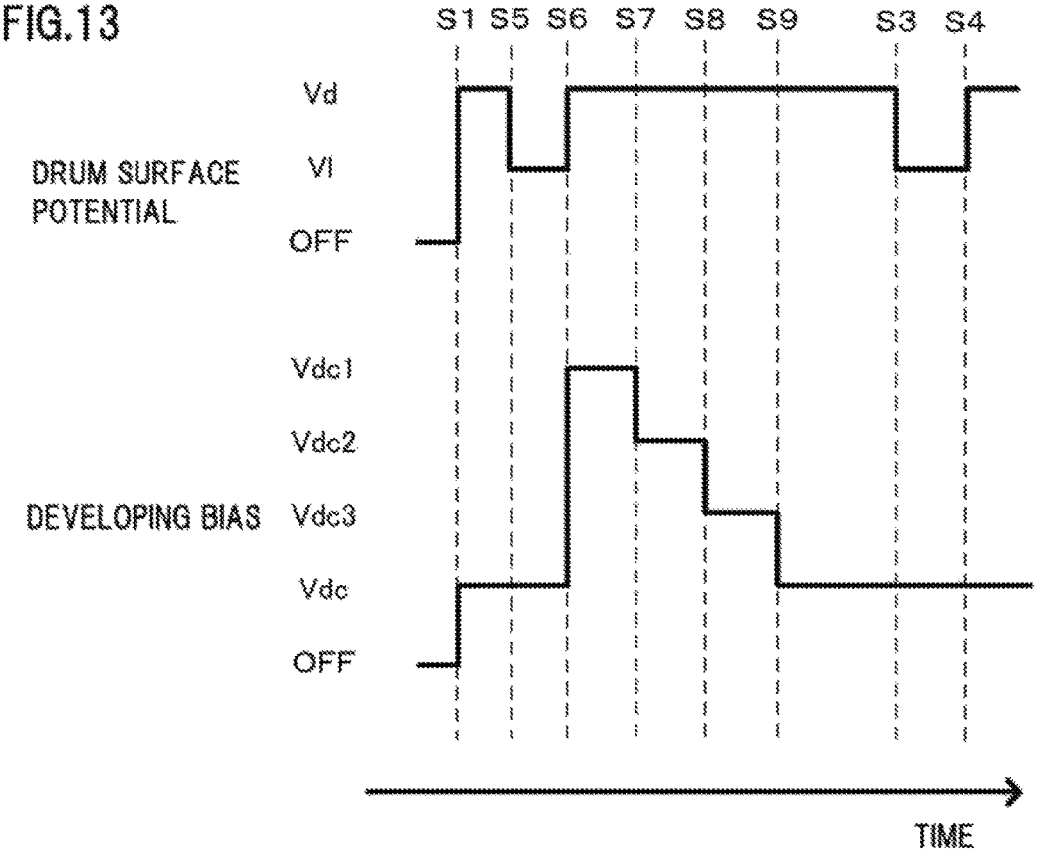
FIG. 13 is a graph depicting the transition of the potentials of the photosensitive drum and the developing roller during the sequence for a new process cartridge.

The transition of the potentials of the photosensitive drum 10 and the developing roller 31 during the sequence for a new process cartridge according to Embodiment 3 will be described with reference to FIG. 13. First, the user turns on the main body power supply and inserts a new process cartridge 1 into the apparatus main body 70. Then, the communication unit 75 determines whether or not the process cartridge 1 is new based on the data stored in the storage element 12.

Subsequently, the charging high voltage and the developing high voltage are turned on. Then, the developing roller 31, the photosensitive drum 10, and the toner feeding roller 33 are driven, and the developing bias is adjusted to Vdc, while the charging bias is adjusted to Vd (S1). When charging of the photosensitive drum 10 is complete for an entire circumference thereof, exposure is started (S5). Subsequently, the exposure is stopped to change the surface potential of the photosensitive drum 10 back to Vd (S6), and then, the absolute value of the developing bias Vdc is increased (increased toward negative values and set to Vdc1) (S6). Then, the absolute value of the developing bias is sequentially switched from Vdc1 and reduced, down to Vdc2 and Vdc3 on a step-by-step basis (increased toward positive values) (S7 and S8). When the discharge of the lubricant is complete, the developing bias is changed from Vdc3 back to Vdc (S9). Finally, the surface of the photosensitive drum 10 is subjected to exposure by the exposure apparatus 2 to reduce the surface potential of the photosensitive drum 10 with respect to the developing bias, down to Vl, in order to feed the toner onto the cleaning blade 50 (S3). When the discharge of the toner is complete, the surface potential of the photosensitive drum 10 is changed back to Vd (S4) to end the sequence for a new process cartridge.

The time between S5 and S6 and the time between S7 and S9 may be changed as needed depending on the falling state of the toner and the lubricant. In addition, Vdc1, Vdc2, and Vdc3 may be changed as needed. In Embodiment 3, Vdc1=−505 V, Vdc2=−440 V, and Vdc3=−370 V.

Figure 14:
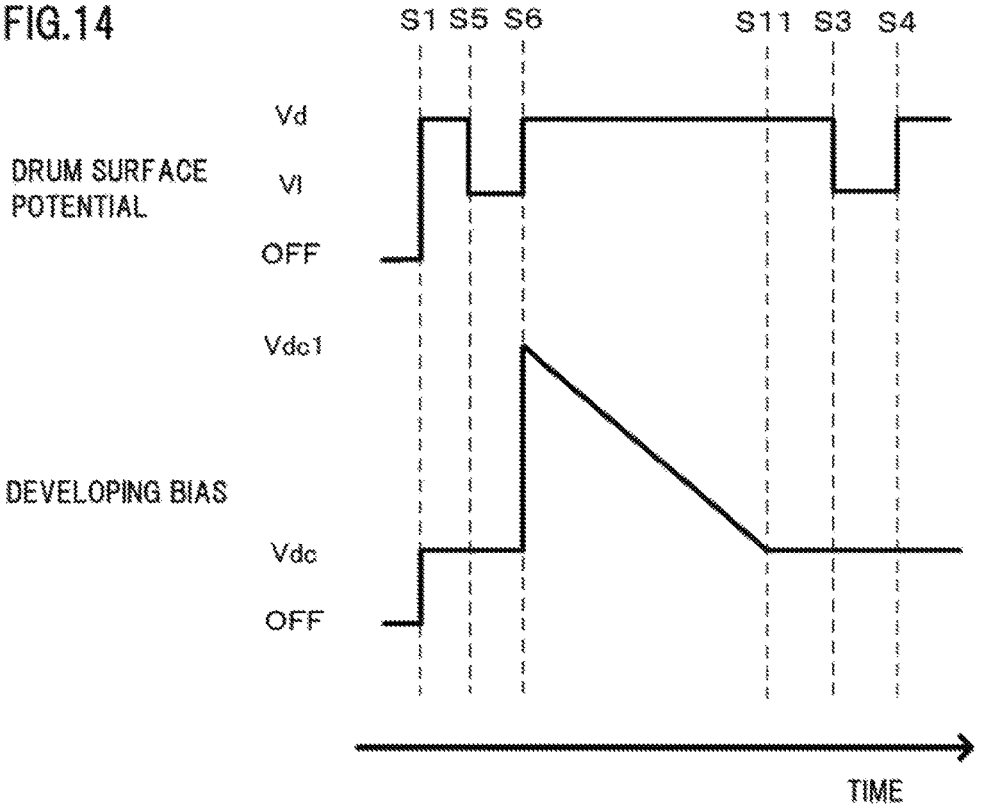
FIG. 14 is a graph depicting the transition of the potentials of the photosensitive drum and the developing roller during the sequence for a new process cartridge.
Figure 15A:
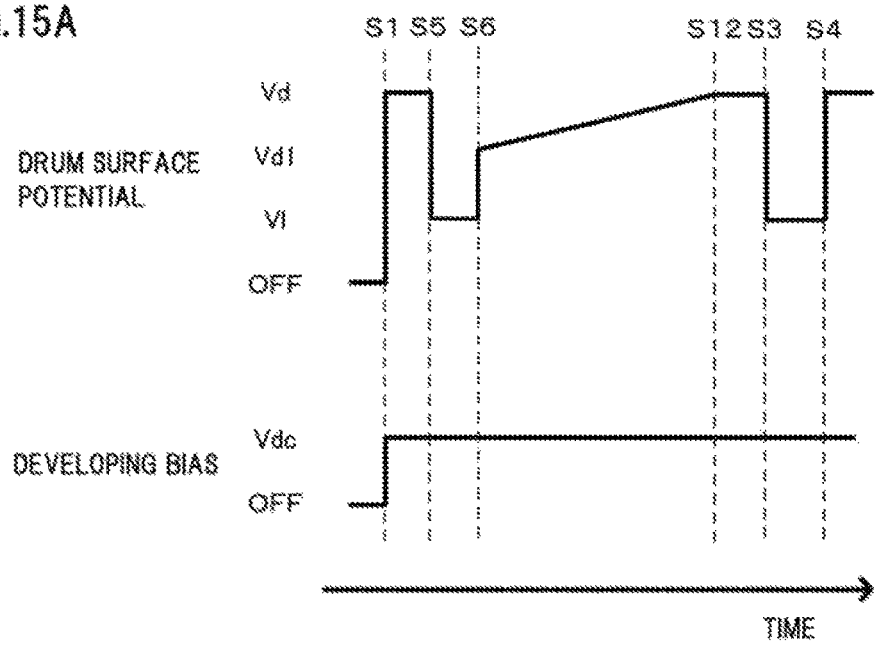
FIG. 15A and FIG. 15B are graphs depicting the transition of the potentials of the photosensitive drum and the developing roller during the sequence for a new process cartridge.
Figure 15B:
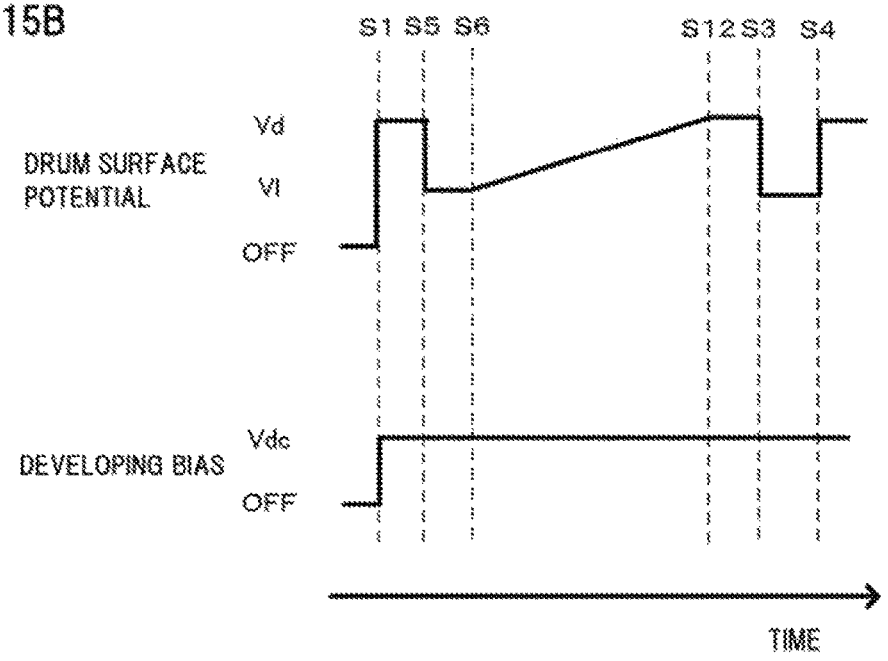

Furthermore, similar effects may be exerted by linearly changing the developing bias Vdc between S6 and S11 as depicted in FIG. 14. Additionally, although the developing bias Vdc is changed after exposure in Embodiment 3, the potential may be changed without the execution of exposure. In addition, although the developing bias Vdc is changed, the surface potential of the photosensitive drum 10 may be changed. For example, the charging bias may be varied from Vd1 to Vd between S6 and S12 as depicted in FIG. 15A or from Vl to Vd using exposure as depicted in FIG. 15B.

<Effects of Embodiment 3>

Effects of Embodiment 3 will be described. When a time difference occurs between the start of execution of the sequence for a new process cartridge and the timing when the toner is coated on the developing roller 31, the potentials are gradually changed after exposure in order to effectively discharge the lubricant of the opposite polarity coated on the developing roller 31. The gradual change in potential allows the lubricant to be suitably discharged even if a longer time elapses before the toner is coated on the developing roller 31. A longer time may elapse before the toner is coated on the developing roller 31, for example, when a longer time is needed to remove the toner seal member 103, when there is a long distance from the toner container 102 to the developing chamber 101, and when a long time is needed to feed the toner.

As described above, in Embodiment 3, the lubricant of the opposite polarity coated on the developing roller 31 can be suitably discharged onto the photosensitive drum 10, for the case where a time difference occurs between the start of execution of the sequence for a new process cartridge and the timing when the toner is coated on the developing roller 31.

Embodiment 4

Now, Embodiment 4 will be described. In the first to third embodiments, the case of the monochromatic image forming apparatus has been described. However, the present invention is applicable to the case of a full, four-color image forming apparatus. Thus, in Embodiment 4, the case of a full, four-color image forming apparatus will be described.

Figure 16:
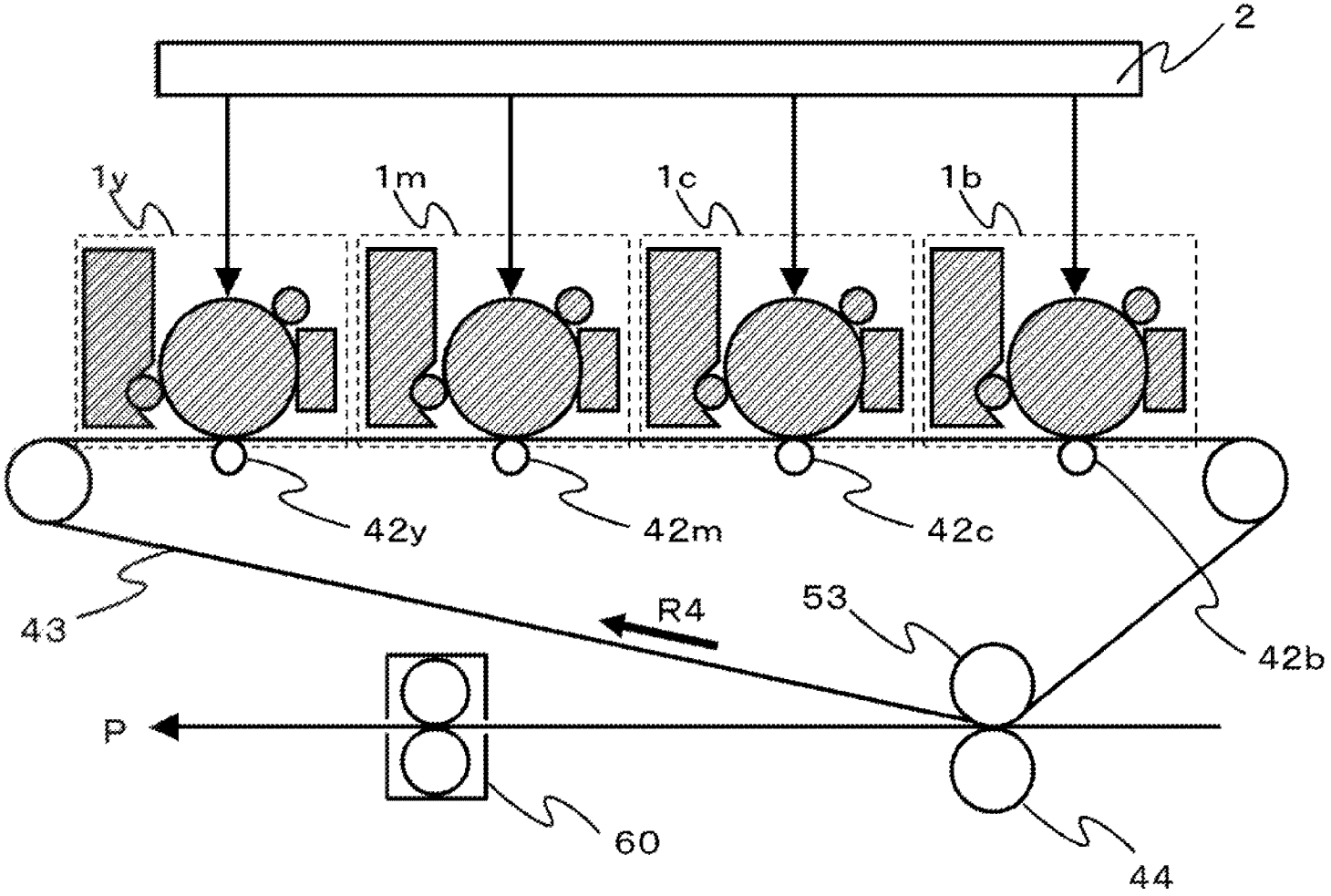
FIG. 16 is a schematic cross-sectional view depicting a part of a configuration of an image forming apparatus according to Embodiments 4 and 6.

FIG. 16 is a schematic cross-sectional view of a configuration of the image forming apparatus according to Embodiment 4. The apparatus main body 70 of the image forming apparatus according to Embodiment 4 includes process cartridges 1*y*, 1*m*, 1*c*, and 1*b* which contain toner in yellow (y), magenta (m), cyan (c), and black (b) and which are removable. The apparatus main body 70 includes an intermediate transfer belt 43 which can move cyclically in the direction of arrow R4 in FIG. 16 and which serves as an intermediate transfer member. Furthermore, the image forming apparatus according to Embodiment 4 has a plurality of photosensitive drums 10 serving as image bearing members and primary transfer rollers (transfer unit) 42*y* to 42*b* opposed to the respective photosensitive drums 10 via the intermediate transfer belt 43. Toner images formed on the plurality of photosensitive drums 10 are sequentially transferred onto the intermediate transfer belt 43.

Figure 17:
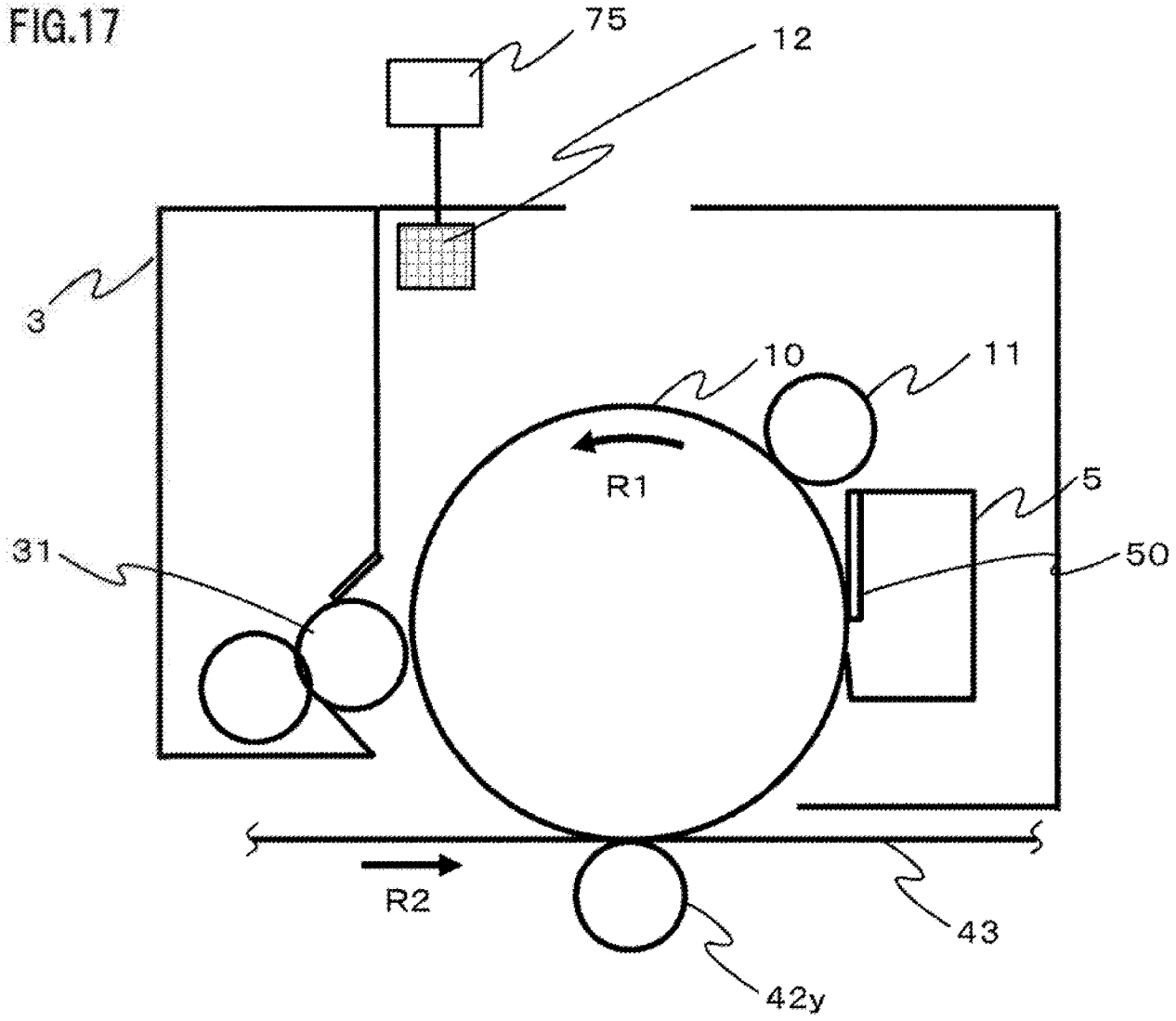
FIG. 17 is a schematic cross-sectional view depicting a configuration of a process cartridge according to Embodiments 4 and 6.

FIG. 17 is a schematic cross-sectional view specifically depicting the process cartridges 1*y* to 1*b* depicted in FIG. 16. In this regard, the process cartridges 1*y* to 1*b* have substantially the same shape, and thus, FIG. 16 depicts a schematic diagram illustrating the process cartridge 1*y* as a representative. As depicted in FIG. 17, the process cartridge 1*y* according to Embodiment 4 includes the photosensitive drum 10 serving as an image bearing member, the charging roller 11 serving as a charging unit, the developing assembly 3, the cleaning apparatus 5, and usage history detecting unit 12 for the process cartridge 1.

The photosensitive drum 10 is evenly charged to a predetermined polarity and a predetermined potential by the charging roller 11 while rotating in the direction of arrow R1 in FIG. 17. A laser beam emitted by the exposure apparatus in the image forming apparatus impinges on the photosensitive drum to form an electrostatic latent image.

The developing assembly that is an example of Embodiment 4 contains nonmagnetic one-component toner with negative charging performance (hereinafter simply referred to as toner) and includes the developing roller 31 serving as a rotatable developer bearing member. The toner is fed from the developing roller 31 to the photosensitive drum 10 to visualize the electrostatic latent image, thus forming a toner image as a developer image.

The toner image formed on the photosensitive drum 10 is primarily transferred to the intermediate transfer belt 43 by a bias applied to the transfer roller 42*y*. The toner image primarily transferred onto the intermediate transfer belt 43 is delivered, through cyclic movement of the intermediate transfer belt 43, to a secondary transfer position where secondary transfer is performed. Subsequently, a secondary transfer roller 44 and a secondary transfer opposite roller 45 secondarily transfer the toner image to the recording material P. The toner image secondarily transferred onto the recording material P is fixed to the recording material P by being heated and pressured by the fixing device 60. The toner image is thus formed into a final image. Furthermore, a portion of the toner image formed on the photosensitive drum 10 which remains thereon instead of being transferred to the intermediate transfer belt 43 is conveyed to the cleaning apparatus 5 and scraped off from the surface of the photosensitive drum 10.

Even in the case of such a full, four-color image forming apparatus, similar effects can be exerted by adopting the configurations in Embodiments 1 to 3. That is, even in Embodiment 4, the lubricant coated on the developing roller 31 and exhibiting charging performance with the polarity opposite to the polarity of the toner can be discharged onto the photosensitive drum 10 without any adverse effect during execution of the sequence for a new process cartridge if the process cartridge 1 is new.

Embodiment 5

<Cleaning Apparatus>

Figure 18:
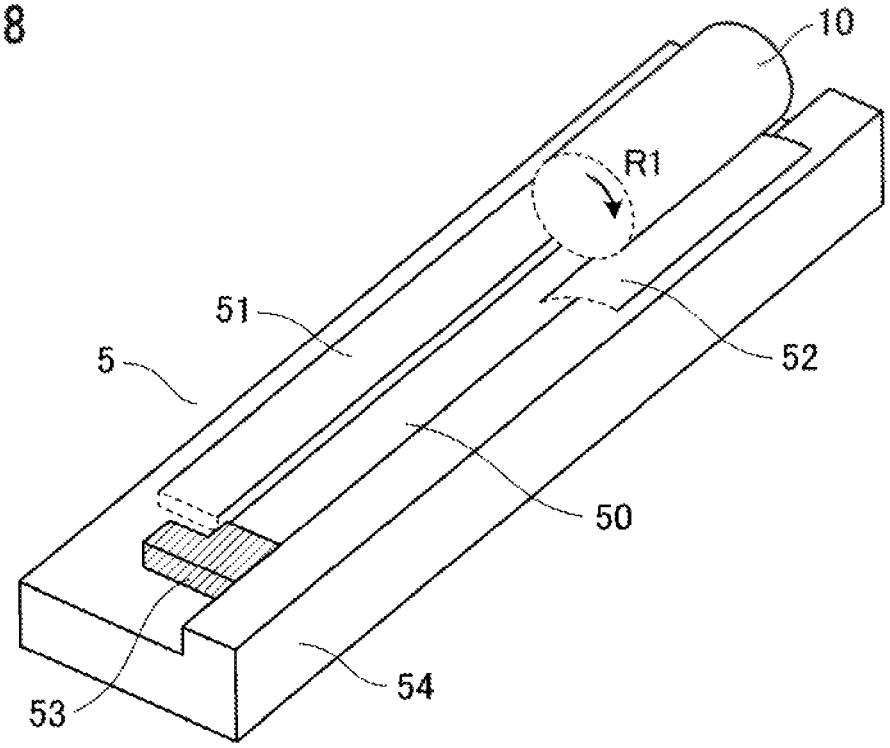
FIG. 18 is a schematic perspective view illustrating a configuration of a cleaning apparatus according to Embodiments 5 and 6.

Now, Embodiment 5 will be described, with reference to FIGS. 18 to 23F. FIG. 18 is a schematic perspective view illustrating a configuration of the cleaning apparatus according to Embodiment 5. In FIG. 18, some members positioned on the front side are depicted in a partially cutaway view in order to illustrate each of the members of the cleaning apparatus.

As depicted in FIG. 18, the cleaning apparatus 5 in Embodiment 5 has the cleaning blade 50, a scoop-up sheet 52, a cleaning end seal 53, and a frame 54 in which the cleaning blade 50, the scoop-up sheet 52, and the cleaning end seal 53 are housed. Furthermore, the frame 54 supports the photosensitive drum 10 so that the photosensitive drum 10 is rotatable. The cleaning blade 50 is formed of an elastic member and contacts the photosensitive drum 10 to remove the toner T from the surface of the photosensitive drum 10 (scrape the toner off from the surface of the photosensitive drum 10). The scraped-off toner is accumulated in the frame 54 through a cleaning opening 50 defined by the frame 54, the scoop-up sheet 52, and the cleaning end seal 53. The scoop-up sheet 52 is a flexible sheet member and closely contacts the photosensitive drum 10 and the cleaning end seal 53 to prevent the toner from leaking from the frame 54. The cleaning end seal 53 is an elastic member having fine nap implanted on a surface thereof that contacts the photosensitive drum 10. The cleaning end seal 53 closely contacts the photosensitive drum 10, cleaning blade 50, the scoop-up sheet 52, and the frame 54 to prevent the toner from leaking through an end of the frame 54.

<Developing Assembly>

Figure 19:
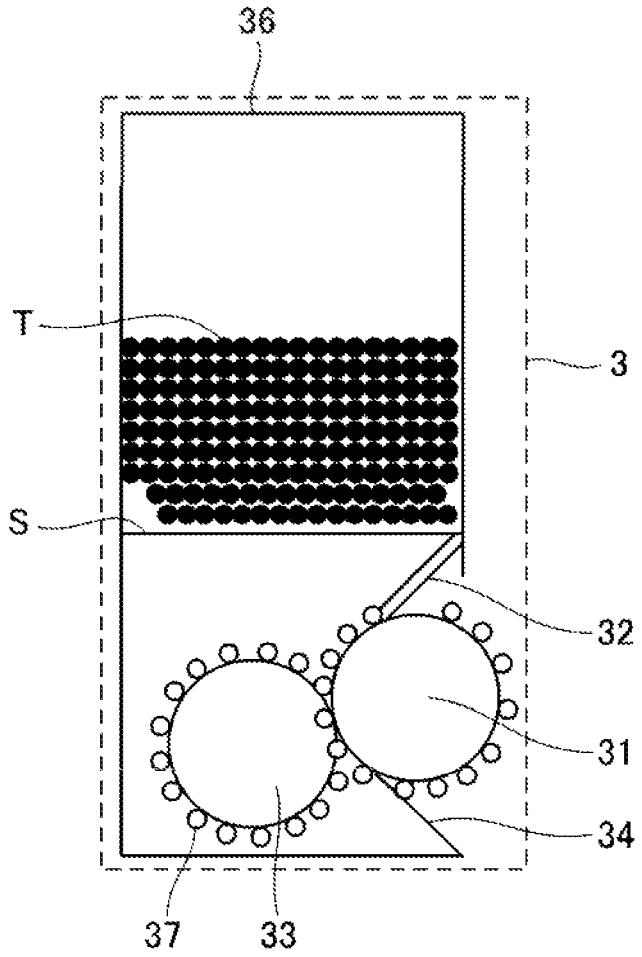
FIG. 19 is a cross-sectional view depicting a developing assembly according to Embodiments 5 and 6.

The developing assembly 3 according to Embodiment 5 will be described with reference to FIG. 19. FIG. 19 is a cross-sectional view depicting a configuration of the developing assembly according to Embodiment 5. In the developing assembly 3 unused, the toner T is contained in the frame 36 using a toner seal S so as not to fly as a result of external vibration or impact. In other words, in the unused state, no toner is present on the developing roller 31, and thus, a massive torque is needed to drive the developing roller 31. In this state, forcible driving may cause the toner feeding roller 33 to be broken due to friction between the developing roller 31 and the toner feeding roller 33 or cause the developing blade 32 to be curled back in a rotating direction of the developing roller 31 due to friction between the developing roller 31 and the developing blade 32.

To solve these problems, a powdery lubricant 37 is pre-coated on any of the developing roller 31, the developing blade 32, and the toner feeding roller 33. Like Embodiment 1, Embodiment 5 selects powder—Dynamic Beads UCN-5060D (manufactured by Dainichiseika Color & Chemicals Mfg. Co., Ltd.) that allow the lubricant to be charged to the positive polarity as a result of rubbing between the lubricant and the developing blade 32. This is, as described later, intended to efficiently direct only the lubricant toward the cleaning blade 50 without wasteful consumption of the toner by selecting the lubricant that is charged to the positive polarity.

<Initial Operation of the Image forming Apparatus>

Figure 20:
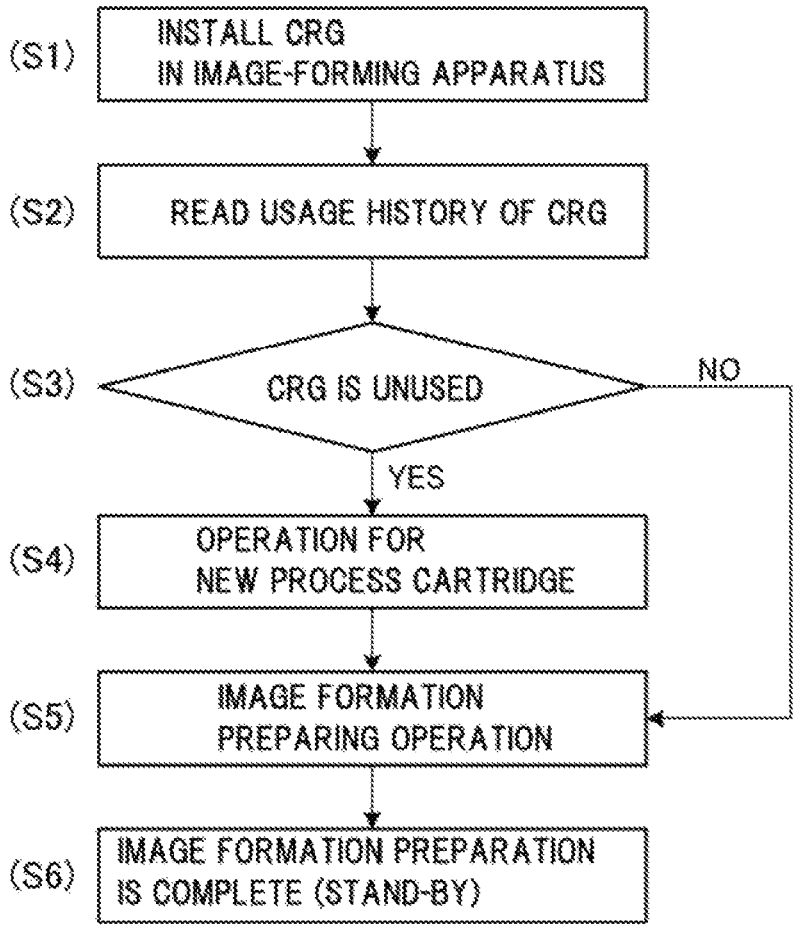
FIG. 20 is a flowchart depicting an initial operation for preparation for image formation according to Embodiments 5 and 6.
Figure 21:
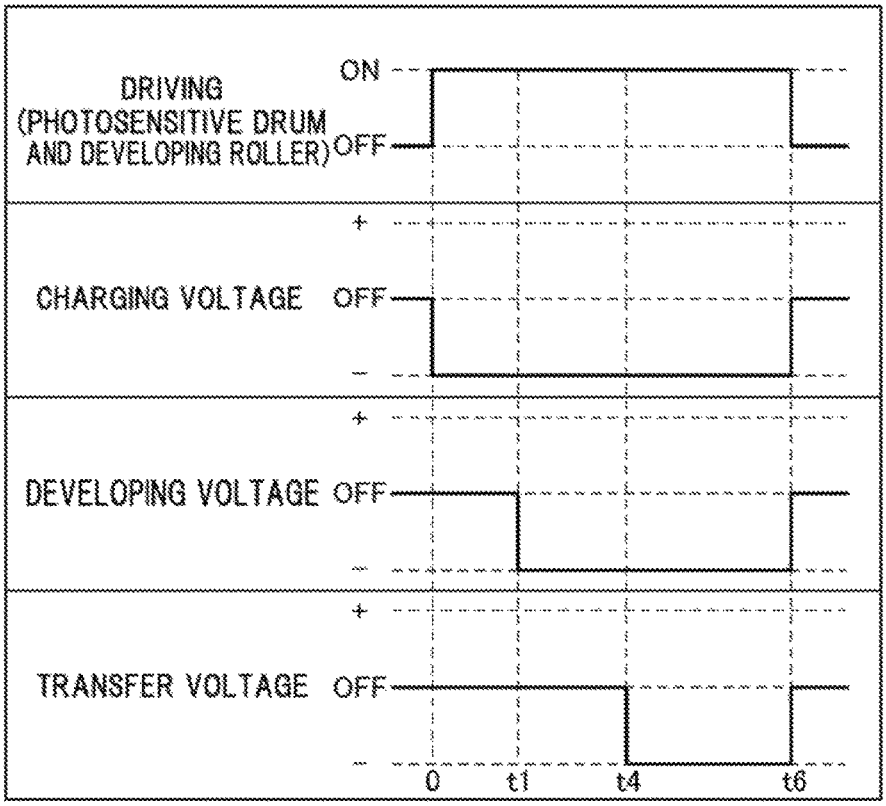
FIG. 21 is a timing chart depicting an image formation preparing operation according to Embodiments 5 and 6.
Figure 22:
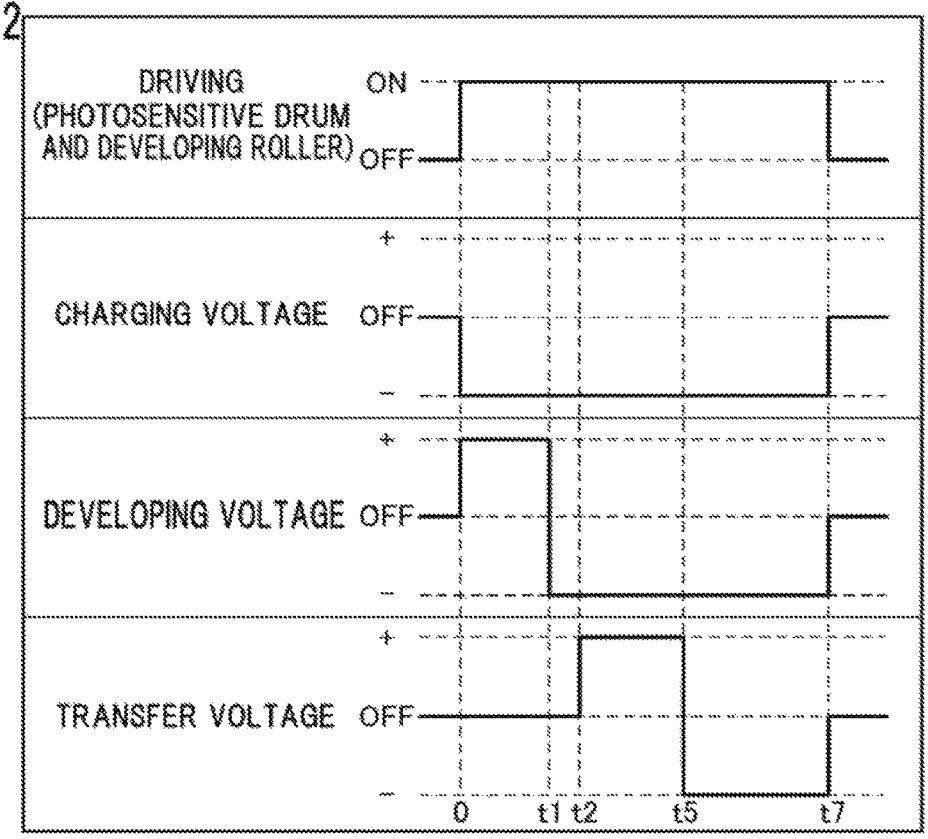
FIG. 22 is a timing chart depicting operations for a new process cartridge according to Embodiments 5 and 6.
Figure 23A:
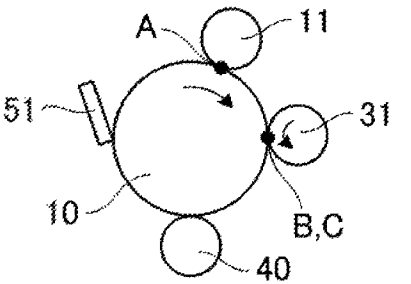
FIGS. 23A to 23F are diagrams illustrating the positions of a photosensitive drum and a developing roller according to Embodiments 5 and 6.
Figure 23B:
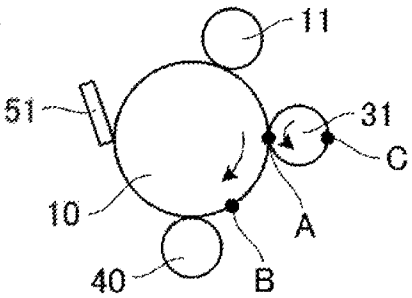
Figure 23C:
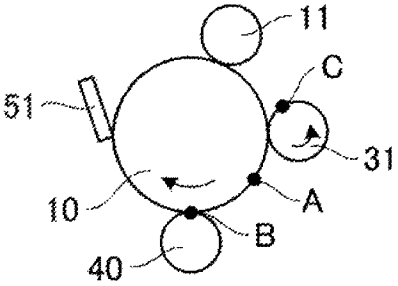
Figure 23D:
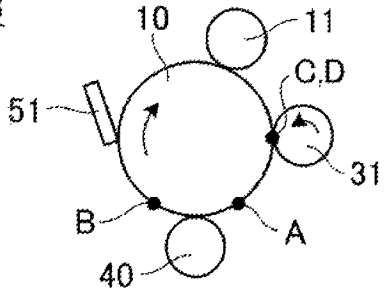
Figure 23E:
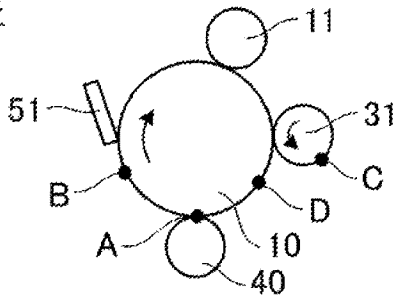
Figure 23F:
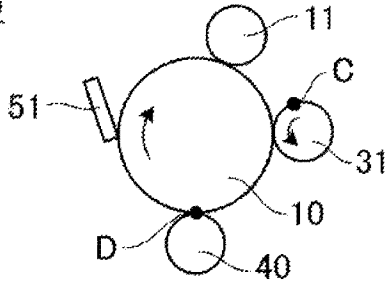

Now, an initial operation of the image forming apparatus according to Embodiment 5 with reference to FIG. 1 and FIGS. 20 to 23F. FIG. 20 is a flowchart depicting an initial operation for preparation for image formation according to Embodiment 5. FIG. 21 is a timing chart depicting an image formation preparing operation (S3) according to Embodiment 5. FIG. 22 is a timing chart depicting operations for a new process cartridge (S4) according to Embodiment 5. FIGS. 23A to 23F are diagrams illustrating the positions of the photosensitive drum and the developing roller at each point in time during the operation according to Embodiment 5. The definitions of points in time t0 to t7 depicted in FIGS. 21 to 23F and points A to D depicted in FIGS. 23A to 23F will be described below.

Point A: A position on the surface of the photosensitive drum 10 that was in contact with the charging roller 11 at a driving start time (t=0)

Point B: A position on the surface of the photosensitive drum 10 that was in contact with the developing roller 31 at the driving start time (t=0)

Point C: A position on the surface of the developing roller 31 that was in contact with the photosensitive drum 10 at the driving start time (t=0)

Point D: A position on the surface of the photosensitive drum 10 that was in contact with the point C when the point C made one rotation after the start of driving.

These positions are hereinafter referred to as the point A, the point B, the point C, and the point D.

t=0: The point in time when driving is started.

t=t1: The point in time when the point A reaches a position where the point A lies opposite the developing roller 31 t=t2: The point in time when the point B reaches a position where the point B lies opposite the transfer roller 40 t=t3: The point of time when the point C has made one rotation (when the developing roller 31 has made one rotation)

t=t4: The point in time when the point A reaches a position where the point A lies opposite the transfer roller 40 t=t5: The point in time when the point D reaches a position where the point D lies opposite the transfer roller 40 t=t6 and t7: The point in time when voltage application and driving are stopped The flow of the initial operation for preparation for image formation according to Embodiment 5 will be described with reference to FIG. 20. The process cartridge 1 is installed in the image forming apparatus (S1). Then, the communication unit 75 in the image forming apparatus main body reads the usage history from the storage element 12 installed in the process cartridge 1 (S2) to determine whether the process cartridge 1 is unused (S3). When the process cartridge 1 is determined not to be unused (NO in S3), a normal image formation preparing operation is performed (S5). When the process cartridge 1 is determined to be unused (YES in S3), the operations for a new process cartridge (S4) are performed, and then, the image formation preparing operation is performed (S5). When these operations end, the preparations for image formation are complete, and the apparatus enters a standby state (S6).

<Image Formation Preparing Operation (S5)>

Now, the image formation preparing operation (S5) will be described with reference to FIG. 21. First, the photosensitive drum 10 and the developing roller 31 are driven at the same timing. When the photosensitive drum 10 and the developing roller 31 are driven, the high-voltage power supply 71 for a charging voltage (see FIG. 1) applies a voltage of −1,000 V to the charging roller 11. Thus, the surface of the photosensitive drum 10 is charged to set the surface potential Vd to −450 V.

At the timing of the point in time t=t1 (FIG. 23B) when the point A reaches the position where the point A lies opposite the developing roller 31, the high-voltage power supply 72 for a developing voltage (see FIG. 1) applies the same developing voltage Vdc as that used at the time of image formation, that is, −300 V, to the developing roller 31. Thus, the potential difference between the surface potential Vd of the photosensitive drum 10 and the developing voltage Vdc prevents the toner on the developing roller 31 charged to the negative polarity from being developed on the photosensitive drum 10 to a degree that is higher than necessary.

Furthermore, the high-voltage power supply 73 (see FIG. 1) serving as a third voltage applying unit for a transfer voltage applies −1,000 V—a voltage Vtr of the same polarity as that of the toner to the transfer roller 40 for a duration corresponding to at least one rotation of the transfer roller 40. This is intended to discharge the toner charged to the negative polarity and staining the transfer roller 40, onto the photosensitive drum 10 to clean the transfer roller 40. In Embodiment 5, the potential difference between the potential Vtr of the transfer roller 40, that is, −1,000 V, and the surface potential Vd of the photosensitive drum 10, that is, −450 V, causes the toner on the transfer roller 40 charged to the negative polarity to transfer to the photosensitive drum 10 side.

The timing chart in FIG. 21 depicts that the negative transfer voltage Vtr is applied at the timing of the point in time t=t4 (FIG. 23E) when the point A reaches the position where the point A lies opposite the transfer roller 40. However, the application timing for the transfer voltage Vtr is not limited to this but is optional as long as the relation between the transfer roller voltage Vtr and the surface potential Vd of the photosensitive drum 10 is Vtr<Vd.

Subsequently, at the timing of the point in time t=t6 when the transfer roller 40 has made at least one rotation, the voltage application by the charging, developing, and transfer high-voltage power supplies 71, 72, and 73 is stopped and the driving of the photosensitive drum 10 and the developing roller 31 is stopped to end the image formation preparing operation. Thereafter, the apparatus enters the standby state.

<Operation for a New Process Cartridge (S4)>

Now, the operations for a new process cartridge (S4) will be described with reference to FIG. 22. First, the photosensitive drum 10 and the developing roller 31 are driven at the same timing. When the photosensitive drum 10 and the developing roller 31 are driven, the nigh-voltage power supply 71 for the charging voltage (see FIG. 1) applies a voltage of −1,000 V to the charging roller 11. Thus, the surface of the photosensitive drum 10 is charged to set the surface potential Vd to −450 V. Since when the driving is started until when the point h passes through a position opposite to the developing roller 31 (time t=0 to t1), the high-voltage power supply 72 for the developing voltage (see FIG. 1) applies a voltage of +200 V to the developing roller 31. Alter the start of the driving and before the passage through the position opposite to the developing roller 31, the surface potential Vd of the photosensitive drum 10 is 0 V. Thus, to allow the lubricant on the developing roller 31 charged to the positive polarity to be efficiently developed on the photosensitive drum 10 side, the relation between the surface potential Vd of the photosensitive drum 10 and the potential Vdc of the developing roller 31 is preferably Vd<Vdc.

Then, after the point A reaches the position opposite to the developing roller 31 (t>t1), the high-voltage power supply 72 for the developing voltage (see FIG. 1) applies the same developing voltage as that used at the time of image formation, that is, −300 V, to the developing roller 31. At the point in time t>t1, the surface potential Vd of the photosensitive drum 10 passing through the position opposite to the developing roller 31 is −450 V. When the potential difference between the surface potential Vd of the photosensitive drum 10 and the potential of the developing roller 31 is excessively significant and exceeds discharge start voltages for both the photosensitive drum 10 and the developing roller 31, negative discharge from the photosensitive drum 10 to the developing roller 31 occurs. Thus, the charged polarity of the lubricant on the developing roller 31 charged to the positive polarity is inverted to the negative polarity. This precludes the above-described potential difference Vd<Vdc from allowing the lubricant to be developed on the photosensitive drum 10 side. Hence, at the point in time t>t1, a developing voltage Vdc needs to be selected which is higher than Vd and which prevents discharge from the photosensitive drum 10 to the developing roller 31.

Now, operations in a transfer step will be described. In Embodiment 5, at the point in time t=t2 when the point B reaches the position where the point B lies opposite the transfer roller 40, the high-voltage power supply 73 for the transfer voltage applies a transfer voltage Vtr of +500 V to the transfer roller 40. However, Vtr may be zero or a negative voltage under any condition where the surface potential Vd of the photosensitive drum 10 and the voltage Vtr applied to the transfer roller 40 is Vd<Vtr. With this relation established, the lubricant charged to the positive polarity remains on the photosensitive drum by the action of Coulomb's force and can be collected using the cleaning blade 50. For the timing when the above-described voltage is applied, at least until immediately after the point D reaches the transfer roller 40 (point in time t=t5), much of the lubricant can be efficiently directed to the cleaning blade 50 when the relation between the surface potential of the photosensitive drum 10 and the transfer voltage is as described above.

Subsequently, as is the case with the normal image formation preparing operation (S5), a negative transfer voltage Vtr Of −1,000 V intended to clean the transfer roller 40 is applied until the point in time t=t7 when the transfer roller 40 has made one rotation corresponding to the circumference thereof. Then, the application of the charging, developing, and transfer voltages and the driving of the photosensitive drum 10 and the developing roller 31 are stopped. The apparatus then enters the standby state (S6).

<Verification of the Effects of Embodiment 5>

To verify the effects of the present embodiment, the following experiments were conducted.

[Experiments]

A process cartridge 1 with the developing roller 31 coated with a powder lubricant of $0.50\times10^{-2}$ kg/m$^2$) was used to compare a case where the operations for a new process cartridge described in Embodiment 5 are performed with a case where only the normal image formation preparing operation is performed (Comparative Example 8): in terms of:

the amount of lubricant collected in the cleaning container; and the presence or absence of curl-up of the cleaning blade and stain on the back side of the image.

[Conditions]

Lubricant: Dynamic Beads UCN-5060D (manufactured by Dainichiseika Color & Chemicals Mfg. Co., Ltd.)

Process speed: 80 mm/sec

Applied voltage (Embodiment 1) Operation for a New Process Cartridge

Charging: −1,000 V

Developing: +200 V, −300 V*1

Transfer: 1500 V, −1,000 V*2

(Comparative Example 8) Image Formation Preparing Operation

Charging: −1,000 V

Developing: −300 V

Transfer: −1,000 V

Environment: formal temperature and normal humidity (25° C. and 50%)

+200 V is applied at t=0 to t1, and −300V is applied at t=t1 to t7

+500 V is applied at t=t2 to t5, and −1,000V is applied at t=t5 to t7

[Results]

The results are depicted in Table 4. In Embodiment 5, $0.5\times10^{-2}$ (kg/m$^2$) lubricant was coated, and $0.38\times10^{-2}$ (kg/m$^2$) lubricant was collected using the cleaning blade (hereinafter also referred to as the C blade). Neither curl-up of the cleaning blade 50 nor stain on the back side of the image occurred. Furthermore, in Comparative Example 8 in which only the normal image forming operation was performed, $0.5\times10^{-2}$ (kg/m$^2$) lubricant was coated, but only $0.01\times10^{-2}$ (kg/m$^2$) lubricant was able to be collected. Both curl-up of the cleaning blade and stain on the back side of the image occurred.

TABLE 4

| | Amount of lubricant coated (developing roller) | Amount of lubricant collected (C blade) | Curl-up of C blade | Stain on back side of image |
|---|---|---|---|---|
| Embodiment 5 | 0.0050 (kg/m$^2$) | 0.0038 (kg/m$^2$) | ○ | ○ |
| Comparative Embodiment 8 | 0.0050 (kg/m$^2$) | 0.0001 (kg/m$^2$) | Δ | Δ |

Curl-up of C blade o: No curl-up
Curl-up of C blade Δ: Slight curl-up
Stain on back side of image o: No stain
Stain on back side of image Δ: Slight stain The above-described experimental results allowed the effects of Embodiment 5 to be verified. The configuration of Embodiment 5 enables the lubricant coated on the developing roller 31 to be efficiently fed to the cleaning blade 50 side. This allows enhancement of the performance associated with the problems of the initial curl-up of the cleaning blade and staining of the back side of the image with the lubricant.

Embodiment 5 refers to the case where the toner is charged to the negative polarity, whereas the lubricant, is charged to the positive polarity. However, similar effects can be exerted for a case where the toner is charged to the positive polarity, whereas the lubricant is charged to the negative polarity. This is because reversing the magnitude relation between the photosensitive drum potential Vd and the transfer roller potential Vtr allows an electric field acting in a direction remaining on the photosensitive drum to be formed even after the lubricant passes through the contact region between the photosensitive drum 10 and the transfer roller 40.

Embodiment 6

Moreover, Embodiment 6 will be described with reference to FIG. 16, FIG. 17, FIG. 20, and other figures. In Embodiment 5, the case of the monochromatic image forming apparatus has been described. In Embodiment 6, the case of a full, four-color image forming apparatus will be described.

When all of the process cartridges 1*y*, 1*m*, 1*c*, and 1*b* are unused, the image formation preparing operation (S5) may be performed after all of the four process cartridges perform the operations for a new process cartridge (S4) depicted in the flowchart in FIG. 20. When only one unused process cartridge is inserted during use, if, for example, the process cartridge 1*b* is unused, the process cartridges 1*y*, 1*m*, and 1*c* perform the image formation preparing operation (S5). Then, control may be executed such that only the process cartridge 1*b* performs the operations for a new process cartridge (S4) and then the image formation preparing operation (S5).

When the toner is charged to the negative polarity, whereas the lubricant is charged to the positive polarity, transfer voltage applying unit applies a voltage at a predetermined timing as is the case with Embodiment 1 so that the relation between the potential Vtr of the transfer unit and the surface potential Vd of the image bearing member is Vd<Vtr. Also in Embodiment 6, the above-described relation may be reversed when the toner is charged to the positive polarity, whereas the lubricant is charged to the negative polarity. Thus, the lubricant coated on the developing roller 31 can be efficiently fed to the cleaning blade side, enabling prevention of image defects or stain on the back side of the image caused by faulty cleaning resulting from curl-up of the end of the cleaning blade.

As described above, in Embodiments 1 to 6, the lubricant discharging operation is performed by changing the output from at least one of the high-voltage power supply 71 for the charging voltage, the high-voltage power supply 72 for the developing voltage, and the exposure apparatus 2. Embodiments 1 to 6 are characterized in that the lubricant discharging operation is controlled such that an appropriate amount of lubricant can be discharged at the appropriate timing, by changing the above-described output to control the potential difference between the surface potential of the developing roller 31 and the surface potential of the photosensitive drum 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-085460, filed on Apr. 17, 2014, which is hereby incorporated by reference herein in its entirety.

What is claimed is:

1. An image forming apparatus comprising:

a cartridge including an image bearing member and a developer bearing member that bears a developer, and a detection unit configured to detect if the cartridge is new, wherein a lubricant of a polarity opposite to a polarity of the developer is coated on the developer bearing member; and if the cartridge is detected to be new, prior to start of an image forming operation, a discharging operation of discharging the lubricant from a surface of the developer bearing member onto the image bearing member is performed, wherein the developer bearing member is configured to receive a developing bias, and when a predetermined time elapses from a start of the discharging operation and before an end of the discharging operation, (i) an absolute value of the developing bias is set greater than when the discharging operation is started and (ii) a potential difference between a surface potential of the image bearing member and a surface potential of the developer bearing member is set smaller than when the discharging operation is started.

2. The image forming apparatus according to claim 1, wherein, when the predetermined time elapses from a start of the discharging operation and before an end of the discharging operation, a surface potential of the image bearing member is the same as when the discharging operation is started.

3. The image forming apparatus according to claim 1, wherein before the predetermined time elapses from the start of the discharging operation, a surface potential of the image bearing member is lowered.

4. The image forming apparatus according to claim 1, further comprising:

a charging unit for charging a surface of the image bearing member; and an exposure unit for implementing exposure on the surface of the charged image bearing member, wherein before the predetermined time elapses from the start of the discharging operation, the surface of the image bearing member is charged along a circumferential direction by the charging unit, and then exposure is implemented on the surface of the image bearing member.

5. The image forming apparatus according to claim 1, wherein in the discharging operation, the surface potential of the developer bearing member is changed on a step-by-step basis.

6. The image forming apparatus according to claim 1, wherein in the discharging operation, the surface potential of the developer bearing member is linearly changed.

7. The image forming apparatus according to claim 1, further comprising a developing chamber in which the developer bearing member is provided and a developer container in which developer is contained and from which the developer is fed to the developing chamber, with the developing chamber and the developer container being connected together through an opening, the cartridge comprising a seal member that seals the opening when the cartridge is new, wherein the seal member is removable to allow the developer to be fed from the developer container to the developing chamber prior to finish of the discharging operation.

8. The image forming apparatus according to claim 1, further comprising a regulating member that contacts the developer bearing member to regulate a layer thickness of the developer on the developer bearing member.

9. The image forming apparatus according to claim 1, further comprising a feeding member that feeds the developer to the developer bearing member, wherein the feeding member is coated with the lubricant, and the lubricant is delivered from the feeding member to the developer bearing member and attached to the developer bearing member.

* * * * *